US012471727B2

(12) United States Patent
Davidoff

(10) Patent No.: US 12,471,727 B2
(45) Date of Patent: Nov. 18, 2025

(54) COMPACT GARMENT HANGER

(71) Applicant: Jessica Davidoff, New York, NY (US)

(72) Inventor: Jessica Davidoff, New York, NY (US)

(73) Assignee: Jessica Davidoff

( * ) Notice: Subject to any disclaimer, the term of this patent is extended or adjusted under 35 U.S.C. 154(b) by 29 days.

(21) Appl. No.: 18/305,729

(22) Filed: Apr. 24, 2023

(65) Prior Publication Data

US 2023/0255380 A1 Aug. 17, 2023

Related U.S. Application Data

(63) Continuation of application No. 16/946,298, filed on Jun. 15, 2020, now Pat. No. 11,633,057, which is a continuation of application No. 15/892,445, filed on Feb. 9, 2018, now Pat. No. 10,687,645, which is a continuation-in-part of application No. PCT/US2017/036882, filed on Jun. 9, 2017.

(51) Int. Cl.

| | |
|---|---|
| ***A47G 25/16*** | (2006.01) |
| ***A47G 25/14*** | (2006.01) |
| ***A47G 25/48*** | (2006.01) |
| ***A47G 25/52*** | (2006.01) |

(52) U.S. Cl.

CPC ..... *A47G 25/1478* (2013.01); *A47G 25/16* (2013.01); *A47G 25/48* (2013.01); *A47G 25/485* (2013.01); *A47G 25/52* (2013.01); *A47G 2200/106* (2013.01)

(58) Field of Classification Search

CPC ..... A47G 25/14; A47G 2200/106

See application file for complete search history.

(56) References Cited

U.S. PATENT DOCUMENTS

| | | | | | |
|---|---|---|---|---|---|
| 2,122,617 | A * | 7/1938 | Mcd | A47G 25/14 | 223/92 |
| 2,260,444 | A * | 10/1941 | Ellison | A47G 25/52 | 223/88 |
| 2,383,009 | A * | 8/1945 | Siegfried | A47G 25/14 | 223/98 |
| 2,685,991 | A * | 8/1954 | Goza | A47G 25/28 | 223/95 |
| 2,761,599 | A * | 9/1956 | Lancaster | A47G 25/14 | 223/92 |
| 2,990,985 | A * | 7/1961 | Begley | A47G 25/24 | 223/92 |
| 3,157,325 | A * | 11/1964 | Schaefer | A47G 25/24 | 223/91 |
| 3,643,841 | A * | 2/1972 | Rhindress | A47G 25/16 | 223/95 |

(Continued)

*Primary Examiner* — Ismael Izaguirre

(74) *Attorney, Agent, or Firm* — HIPP LAW

(57) ABSTRACT

A hanger is provided which supports long garments securely and easily in half or less length than the garment would occupy hanging on a conventional hanger. Such a garment hanger comprises: a primary support including a hook and elements arranged to suspend a top portion of a garment; an auxiliary support including a bar for suspending the bottom portion of the garment, shortening a total length of the garment thus supported; and the primary support and the auxiliary support including cooperative, non-locking elements detachably suspending the auxiliary support from the primary support with the bar close to the primary support.

17 Claims, 42 Drawing Sheets

(56) References Cited

U.S. PATENT DOCUMENTS

| | | | | | |
|---|---|---|---|---|---|
| 3,651,999 | A * | 3/1972 | Fiocca | A47G 25/16 | 223/88 |
| 4,759,480 | A * | 7/1988 | Duester | A47G 25/485 | 211/113 |
| 4,901,894 | A * | 2/1990 | Blanchard | A47G 25/28 | 223/96 |
| 5,613,628 | A * | 3/1997 | Burkhalter | A47G 25/20 | 223/89 |
| 5,645,200 | A * | 7/1997 | McDowell | A47G 25/28 | 223/89 |
| 5,992,714 | A * | 11/1999 | Morgan | A47G 25/485 | 223/96 |
| 6,988,643 | B2 * | 1/2006 | Gouldson | A47G 25/485 | 223/85 |
| 8,047,410 | B2 * | 11/2011 | Holm | A47F 7/19 | 223/92 |

* cited by examiner

COMPACT GARMENT HANGER

CROSS-REFERENCES TO RELATED APPLICATIONS

This application is a continuation of U.S. application Ser. No. 16/946,298, entitled "COMPACT GARMENT HANGER," filed Jun. 15, 2018, which is a continuation of U.S. application Ser. No. 15/892,445, now U.S. Pat. No. 10,687,645, entitled "COMPACT GARMENT HANGER," filed Feb. 9, 2018, which is a continuation in part of, and claims priority to, International Application No. PCT/US2017/036882, entitled "COMPACT GARMENT HANGER," filed Jun. 9, 2017; which the full disclosure of these applications is incorporated herein by reference for all purposes.

BACKGROUND

The present invention relates to the field of garment hangers.

SUMMARY

According to various embodiments of the invention, a hanger is provided which supports long garments securely and easily in half or less length than the garment would occupy hanging on a conventional hanger.

According to an embodiment of the invention, a garment hanger comprises: a primary support including a hook and elements arranged to suspend a top portion of a garment; an auxiliary support including a bar for suspending the bottom portion of the garment, shortening a total length of the garment thus supported; and the primary support and the auxiliary support including cooperative, non-locking elements detachably suspending the auxiliary support from the primary support with the bar close to the primary support. In one variation, a magnet is provided in one of the primary support and the auxiliary support and a material to which the magnet is attracted is provided in the other of the primary support and the auxiliary support. In another variation, an auxiliary hook extends from the auxiliary support so as to hang over an upper edge of the primary support, for example to each side of or around the hook of the primary support. In yet another variation, the cooperative, non-locking elements include patches of hook-and-loop fastener on the auxiliary support and the primary support. The primary support may include arms extending from the hanger body to provide support to shoulders or shoulder straps of the garment. In some variations, the primary support includes clips extending from the hanger body to provide support to the garment. In other variations, the auxiliary support may include clips extending from the bar to provide support to the bottom portion of the garment. In yet other variations, the bar includes a clip having jaws running substantially the length of the bar providing support to and securing the bottom portion of the garment, as shown and described, or implied by those variations with one or more clips disposed on the primary support.

In other variations, the elements providing for releasable engagement between the primary support and the auxiliary support may include a ball and socket joint, a pin and socket joint either longitudinal with the primary support or transverse to the primary support, other hook and shoulder arrangements, and tab and socket arrangements.

The individual elements of the foregoing variations may be combined in any suitable way to produce other variations of embodiments of the invention.

DESCRIPTION OF THE DRAWINGS

In the following description reference is made to the accompanying drawings, which form a part hereof, and in which are shown example implementations. It should be understood that other implementations are possible, and that these example implementations are intended to be merely illustrative.

FIG. 8H is a front view of the primary support of the seventh embodiment of the hanger.

FIG. 8I is a bottom view of the primary support of the seventh embodiment of the hanger.

FIG. 8J is an axonometric view of the primary support of the seventh embodiment of the hanger.

FIG. 8K is a right-side view of the primary support of the seventh embodiment of the hanger.

FIG. 8L is an axonometric view from a second angle of the primary support of the seventh embodiment of the hanger.

FIG. 8M is a top view of the auxiliary support of the seventh embodiment of the hanger.

FIG. 8N is a front view of the auxiliary support of the seventh embodiment of the hanger.

FIG. 8O is a bottom view of the auxiliary support of the seventh embodiment of the hanger.

FIG. 8P is an axonometric view of the auxiliary support of the seventh embodiment of the hanger.

FIG. 8Q is a right-side view of the auxiliary support of the seventh embodiment of the hanger.

FIG. 8R is an axonometric view from a second angle of the auxiliary support of the seventh embodiment of the hanger.

FIG. 9A is a top view of a eighth embodiment of the hanger, assembled.

Figure 9D:
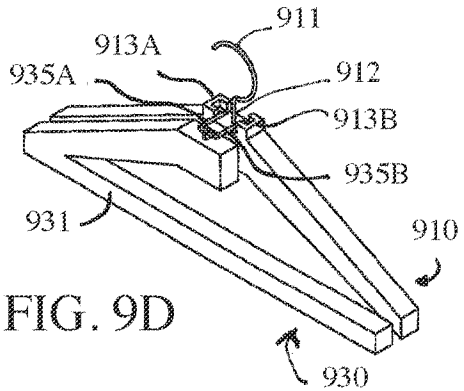
Figure 9E:
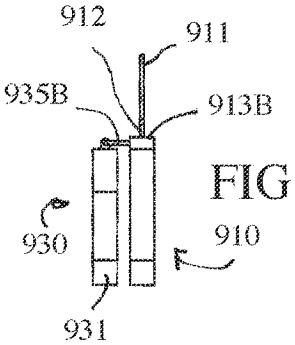
Figure 9F:
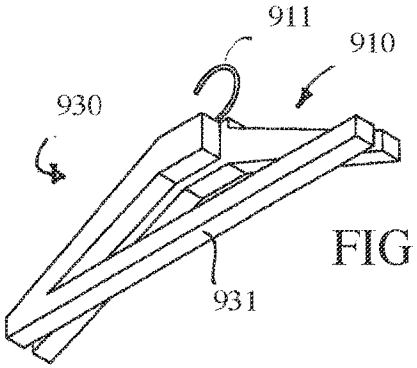
Figure 9A:
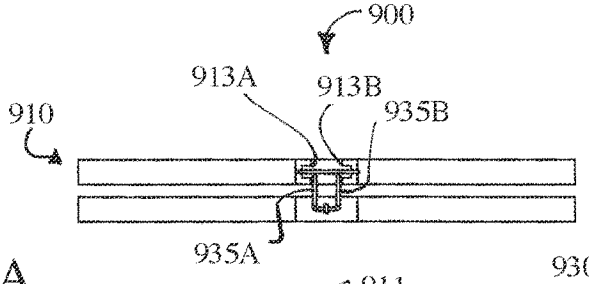
Figure 9B:
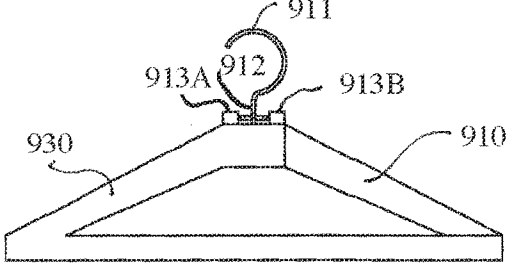

FIG. 9B is a front view of the eighth embodiment of the hanger, assembled.

Figure 9C:
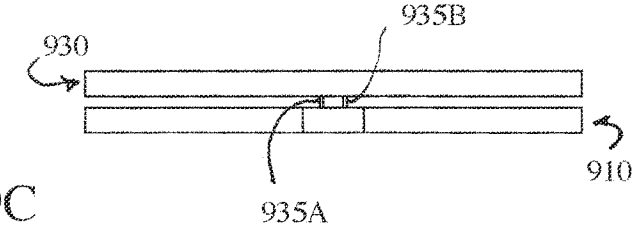

FIG. 9C is a bottom view of the eighth embodiment of the hanger, assembled.

FIG. 9D is an axonometric view of the eighth embodiment of the hanger, assembled.

FIG. 9E is a right-side view of the eighth embodiment of the hanger, assembled.

FIG. 9F is an axonometric view from a second angle of the eighth embodiment of the hanger, assembled.

Figure 9J:
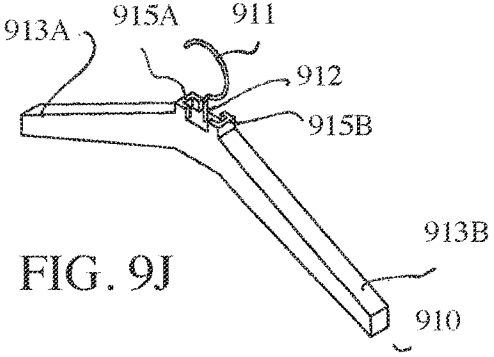
Figure 9K:
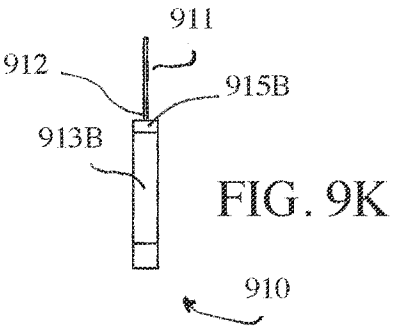
Figure 9L:
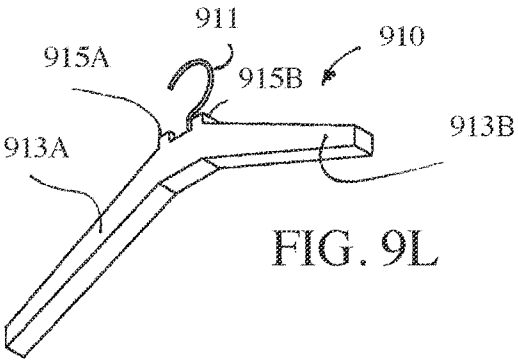
Figure 9G:
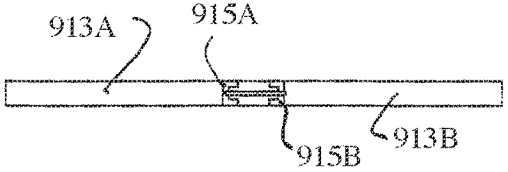

FIG. 9G is a top view of the primary support of the eighth embodiment of the hanger.

Figure 9H:
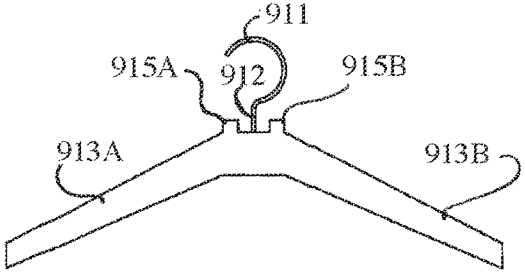

FIG. 9H is a front view of the primary support of the eighth embodiment of the hanger.

Figure 9I:
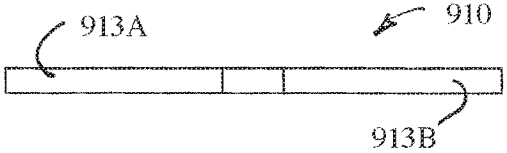

FIG. 9I is a bottom view of the primary support of the eighth embodiment of the hanger.

FIG. 9J is an axonometric view of the primary support of the eighth embodiment of the hanger.

FIG. 9K is a right-side view of the primary support of the eighth embodiment of the hanger.

FIG. 9L is an axonometric view from a second angle of the primary support of the eighth embodiment of the hanger.

Figure 9P:
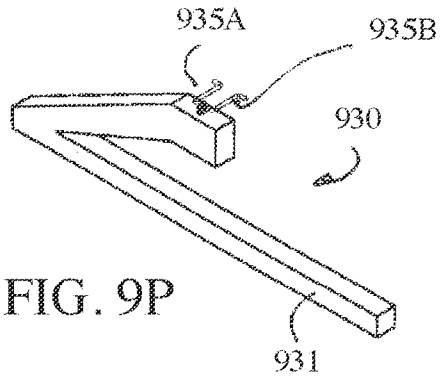
Figure 9Q:
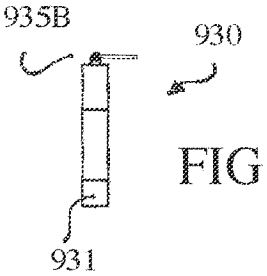
Figure 9R:
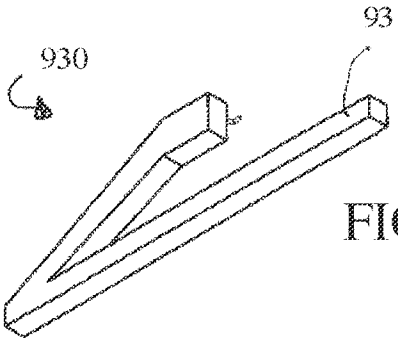
Figure 9M:
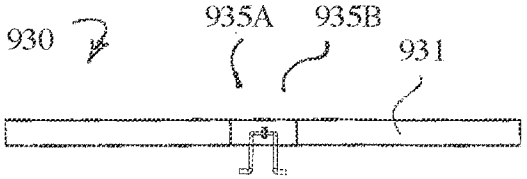

FIG. 9M is a top view of the auxiliary support of the eighth embodiment of the hanger.

Figure 9N:
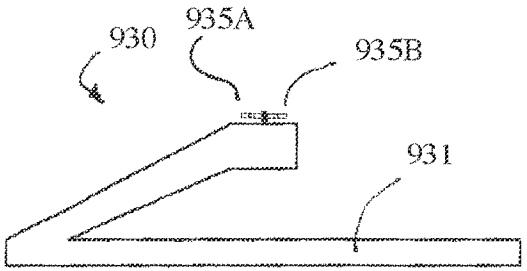

FIG. 9N is a front view of the auxiliary support of the eighth embodiment of the hanger.

Figure 9O:
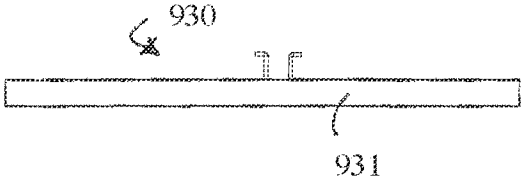

FIG. 9O is a bottom view of the auxiliary support of the eighth embodiment of the hanger.

FIG. 9P is an axonometric view of the auxiliary support of the eighth embodiment of the hanger.

FIG. 9Q is a right-side view of the auxiliary support of the eighth embodiment of the hanger.

FIG. 9R is an axonometric view from a second angle of the auxiliary support of the eighth embodiment of the hanger.

Figure 10D:
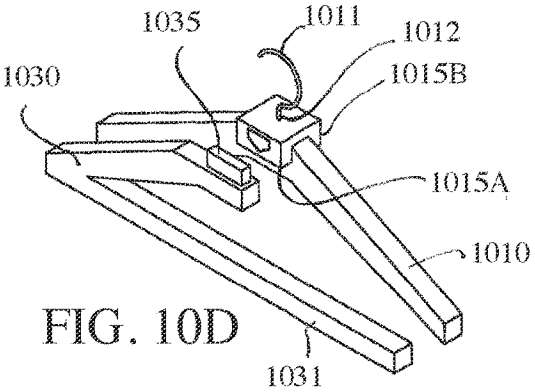
Figure 10E:
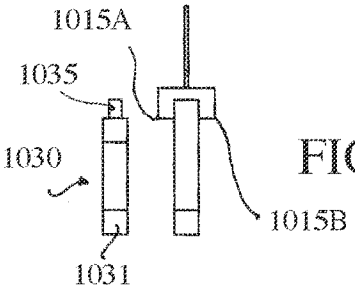
Figure 10F:
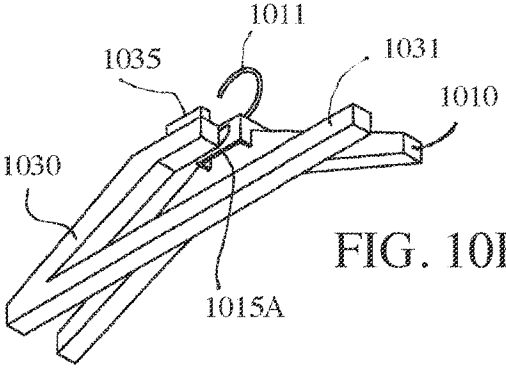
Figure 10A:
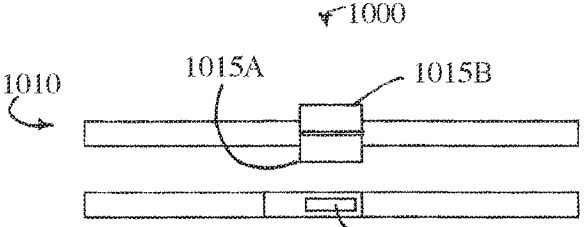

FIG. 10A is a top view of a ninth embodiment of the hanger, assembled.

Figure 10B:
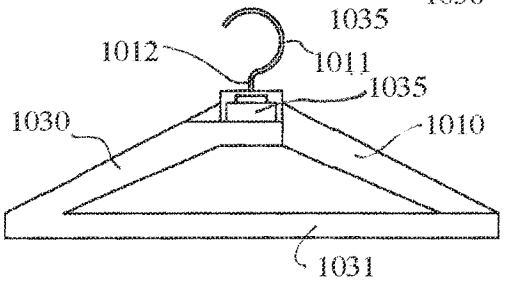

FIG. 10B is a front view of the ninth embodiment of the hanger, assembled.

Figure 10C:
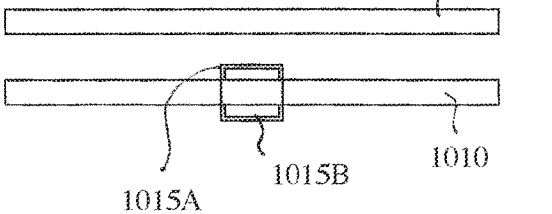

FIG. 10C is a bottom view of the ninth embodiment of the hanger, assembled.

FIG. 10D is an axonometric view of the ninth embodiment of the hanger, assembled.

FIG. 10E is a right-side view of the ninth embodiment of the hanger, assembled.

FIG. 10F is an axonometric view from a second angle of the ninth embodiment of the hanger, assembled.

Figure 10G:
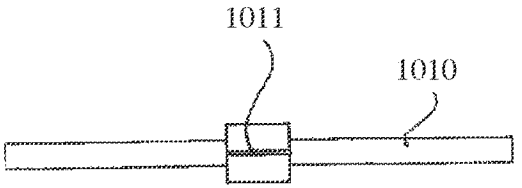

FIG. 10G is a top view of the primary support of the ninth embodiment of the hanger.

Figure 10H:
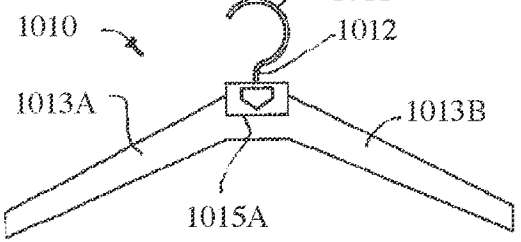

FIG. 10H is a front view of the primary support of the ninth embodiment of the hanger.

Figure 10I:
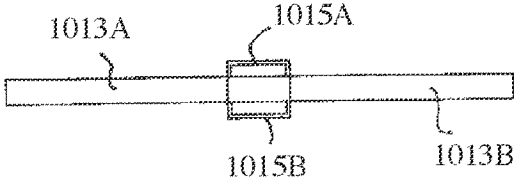

FIG. 10I is a bottom view of the primary support of the ninth embodiment of the hanger.

Figure 10J:
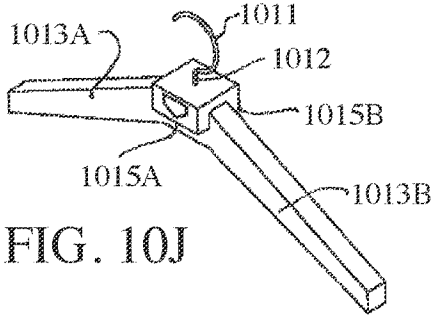

FIG. 10J is an axonometric view of the primary support of the ninth embodiment of the hanger.

Figure 10K:
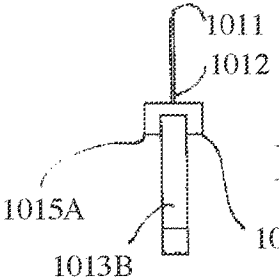

FIG. 10K is a right-side view of the primary support of the ninth embodiment of the hanger.

Figure 10L:
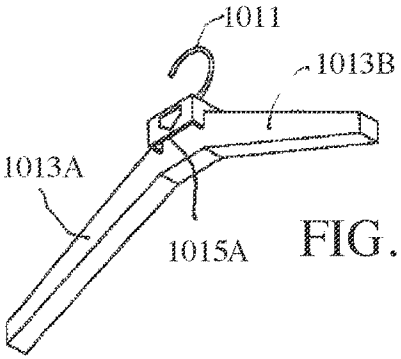

FIG. 10L is an axonometric view from a second angle of the primary support of the ninth embodiment of the hanger.

Figure 10P:
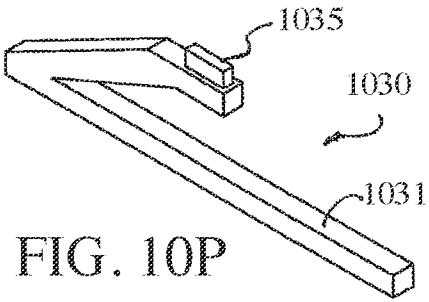
Figure 10Q:
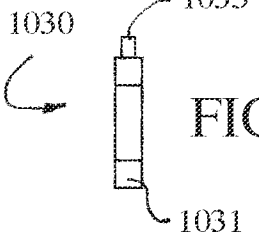
Figure 10R:
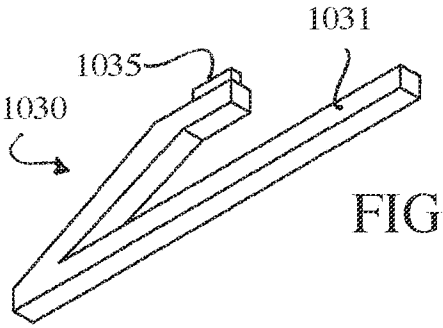
Figure 10M:
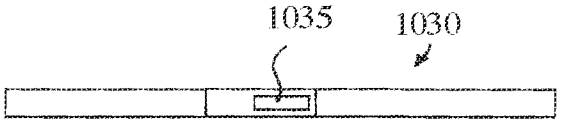

FIG. 10M is a top view of the auxiliary support of the ninth embodiment of the hanger.

Figure 10N:
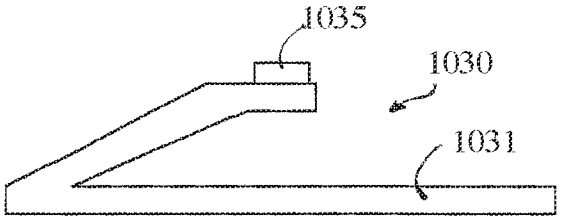

FIG. 10N is a front view of the auxiliary support of the ninth embodiment of the hanger.

Figure 10O:
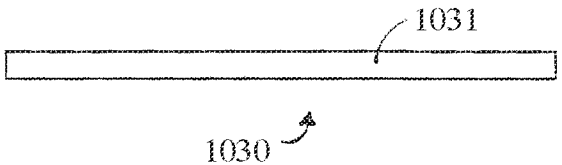

FIG. 10O is a bottom view of the auxiliary support of the ninth embodiment of the hanger.

FIG. 10P is an axonometric view of the auxiliary support of the ninth embodiment of the hanger.

FIG. 10Q is a right-side view of the auxiliary support of the ninth embodiment of the hanger.

FIG. 10R is an axonometric view from a second angle of the auxiliary support of the ninth embodiment of the hanger.

Figure 11D:
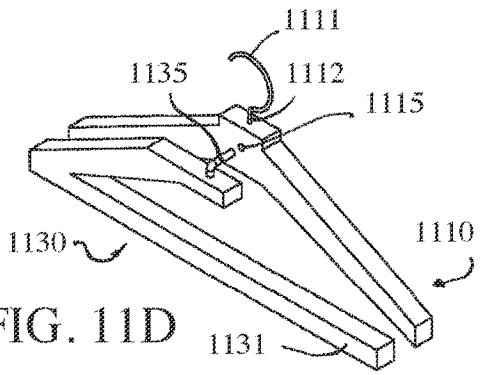
Figure 11E:
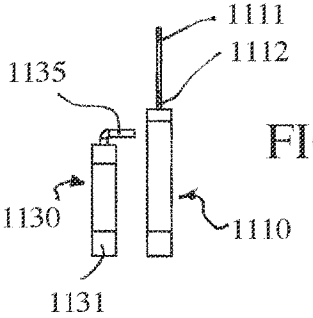
Figure 11F:
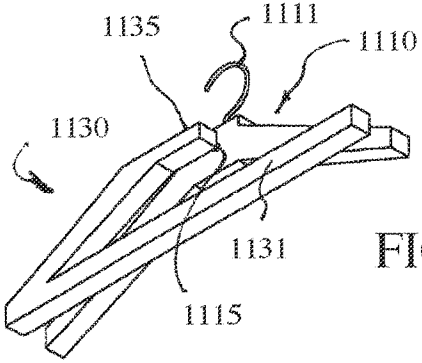
Figure 11A:
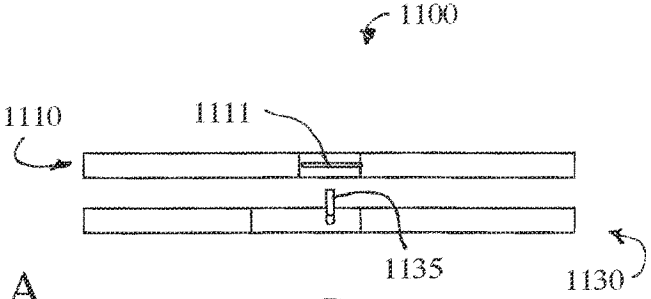

FIG. 11A is a top view of a tenth embodiment of the hanger, assembled.

Figure 11B:
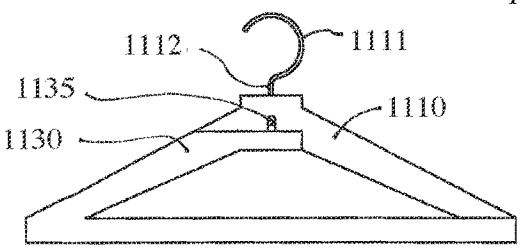

FIG. 11B is a front view of the tenth embodiment of the hanger, assembled.

Figure 11C:
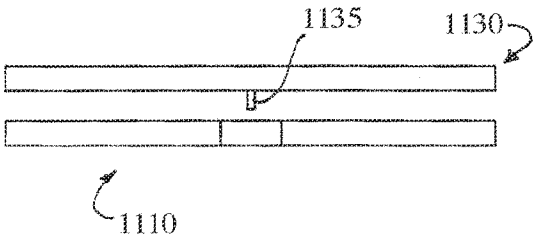

FIG. 11C is a bottom view of the tenth embodiment of the hanger, assembled.

FIG. 11D is an axonometric view of the tenth embodiment of the hanger, assembled.

FIG. 11E is a right-side view of the tenth embodiment of the hanger, assembled.

FIG. 11F is an axonometric view from a second angle of the tenth embodiment of the hanger, assembled.

Figure 11J:
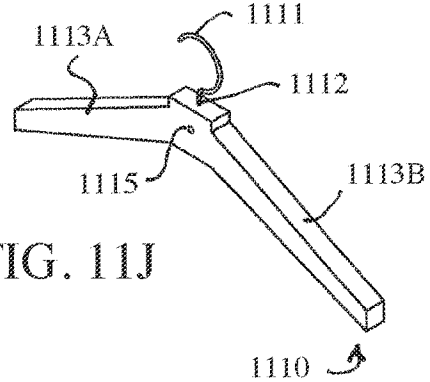
Figure 11K:
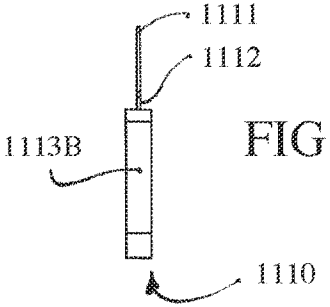
Figure 11L:
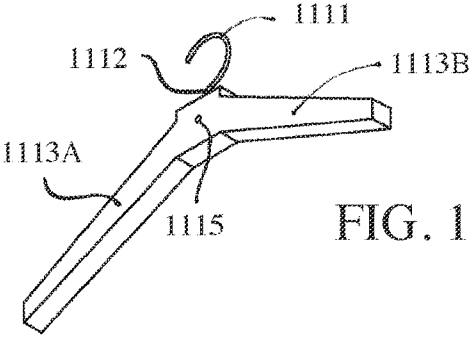
Figure 11G:
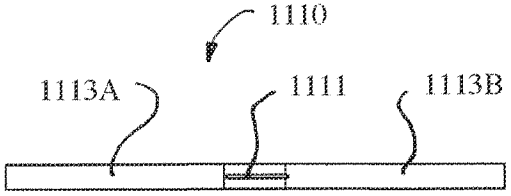

FIG. 11G is a top view of the primary support of the tenth embodiment of the hanger.

Figure 11H:
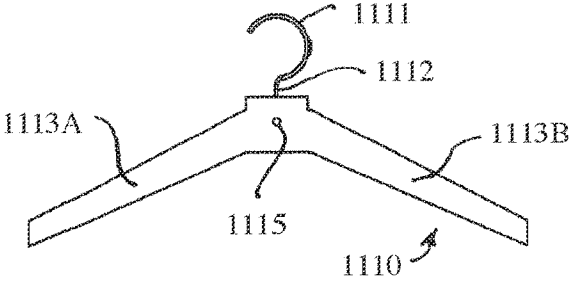

FIG. 11H is a front view of the primary support of the tenth embodiment of the hanger.

Figure 11I:
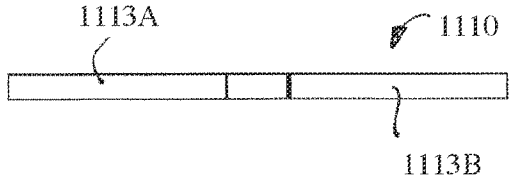

FIG. 11I is a bottom view of the primary support of the tenth embodiment of the hanger.

FIG. 11J is an axonometric view of the primary support of the tenth embodiment of the hanger.

FIG. 11K is a right-side view of the primary support of the tenth embodiment of the hanger.

FIG. 11L is an axonometric view from a second angle of the primary support of the tenth embodiment of the hanger.

Figure 11P:
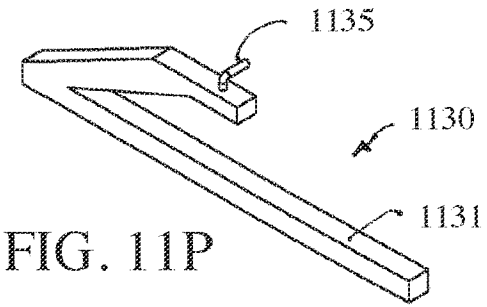
Figure 11Q:
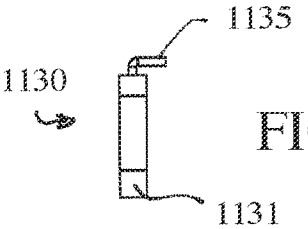
Figure 11R:
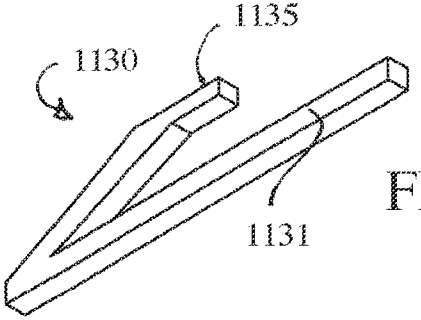
Figure 11M:
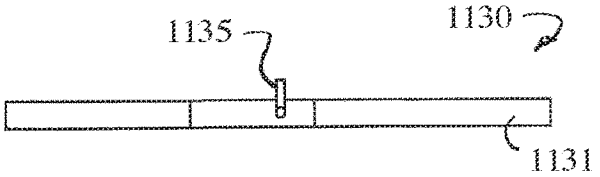

FIG. 11M is a top view of the auxiliary support of the tenth embodiment of the hanger.

Figure 11N:
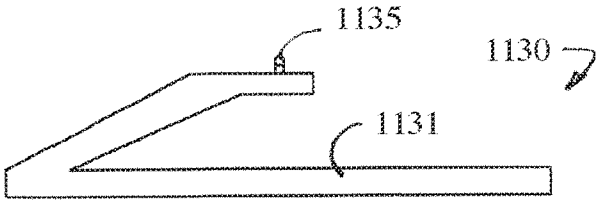

FIG. 11N is a front view of the auxiliary support of the tenth embodiment of the hanger.

Figure 11O:
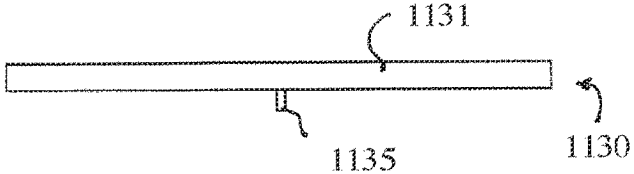

FIG. 11O is a bottom view of the auxiliary support of the tenth embodiment of the hanger.

FIG. 11P is an axonometric view of the auxiliary support of the tenth embodiment of the hanger.

FIG. 11Q is a right-side view of the auxiliary support of the tenth embodiment of the hanger.

FIG. 11R is an axonometric view from a second angle of the auxiliary support of the tenth embodiment of the hanger.

Figure 12:
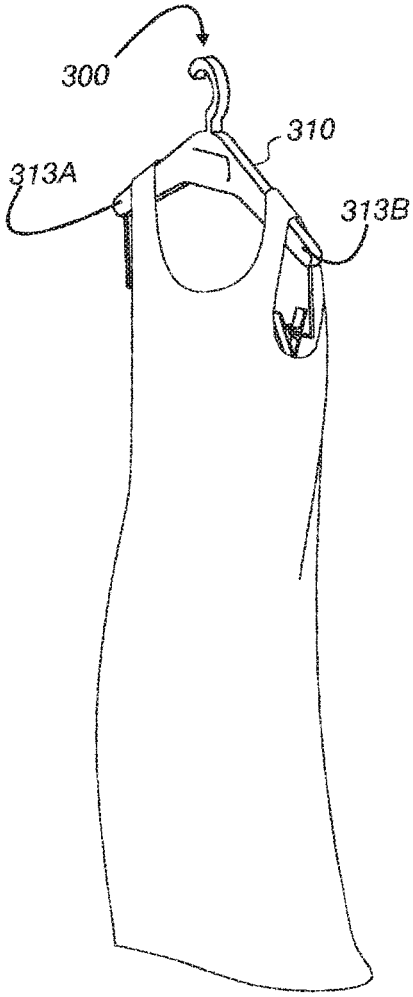
Figure 13:
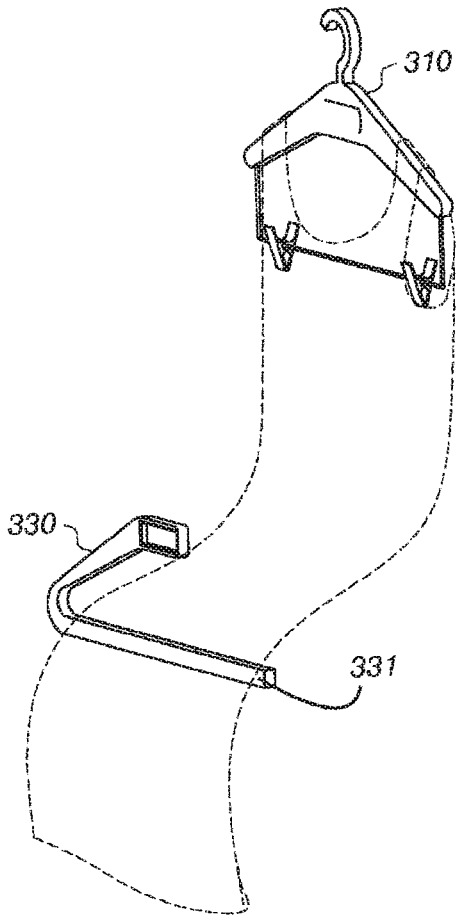
Figure 14:
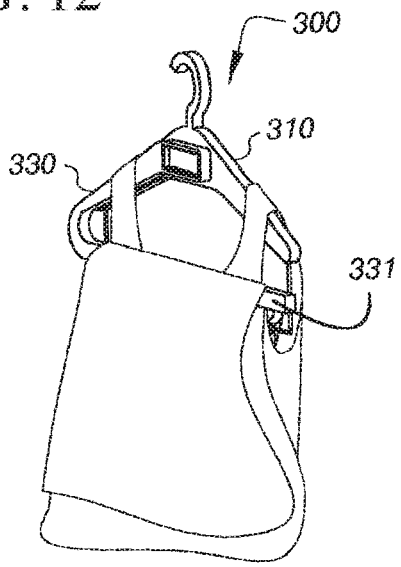

FIGS. 12-14 are perspective views showing the hanger in various states of assembly during use hanging a garment.

DETAILED DESCRIPTION

The following section illustrates by several specific examples, various aspects and embodiments of the invention.

Figure 1A:
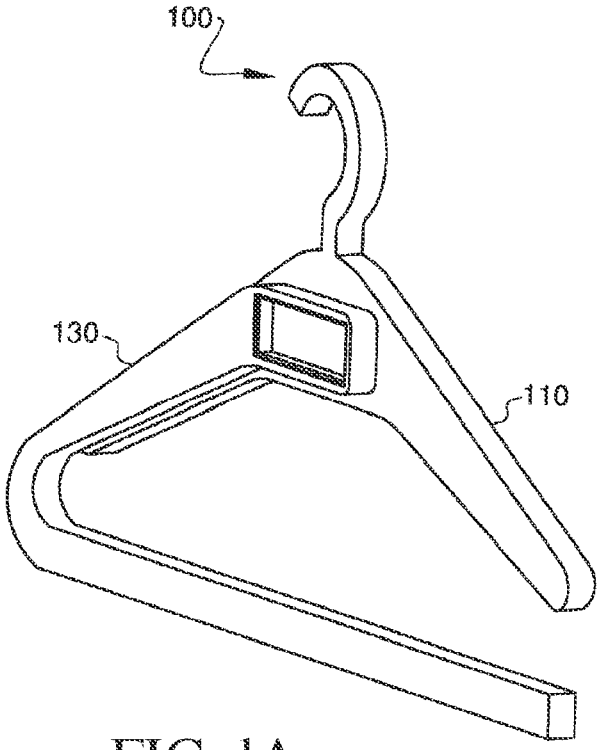
FIG. 1A is an axonometric view of a first embodiment of the hanger, assembled.

Referring to FIG. 1A, a hanger 100 is shown having a primary support 110 for supporting a garment at its shoulders, shoulder straps, or other topmost portion; and an auxiliary support 130 for supporting a garment at its hems, cuffs, or other lowermost portion. The auxiliary support 130 and the primary support 110 incorporate elements that detachably connect the auxiliary support 130 and the primary support 110. The connecting elements may, for example, be a pair of magnets, a magnet and a piece of steel, or hook and loop tape. The connecting elements of this embodiment are held in recesses in primary support 110 and auxiliary support 130 as described below.

Figure 1B:
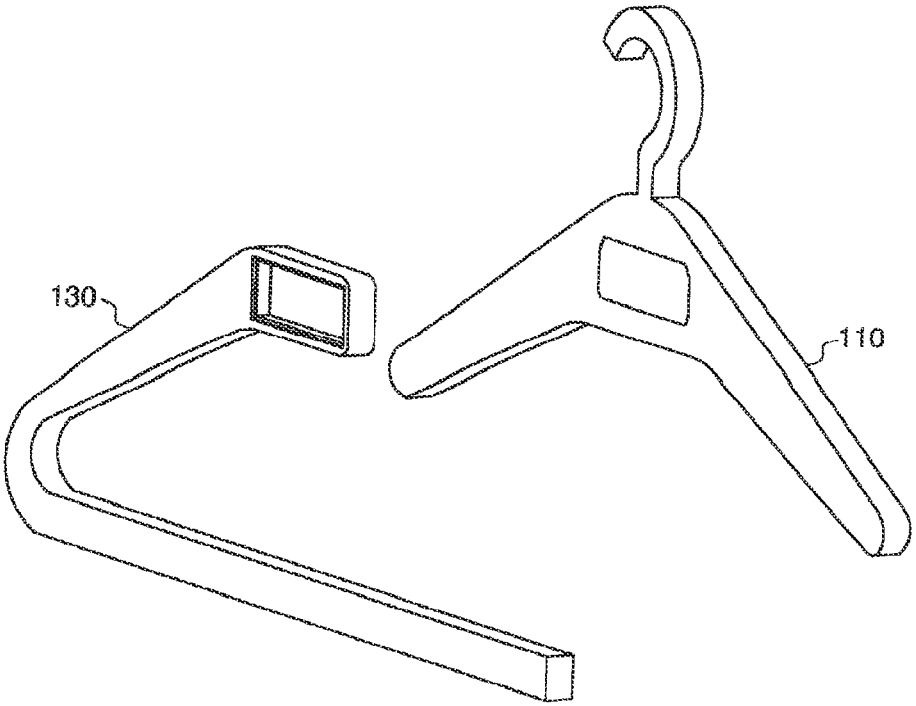
FIG. 1B is an axonometric view of the first embodiment, disassembled.

FIG. 1A shows the hanger 100 assembled in the configuration for storing a garment; FIG. 1B shows the hanger 100 separated into the primary support 110 and the auxiliary support 130. When separated, the shoulder area of a garment is easily placed over arms 113A and 113B of the primary support 110 as it would be on a conventional hanger. But, the lower portion of a long garment, such as a long skirt or dress, can be draped over the bar 131 of auxiliary support 130.

Figure 1C:
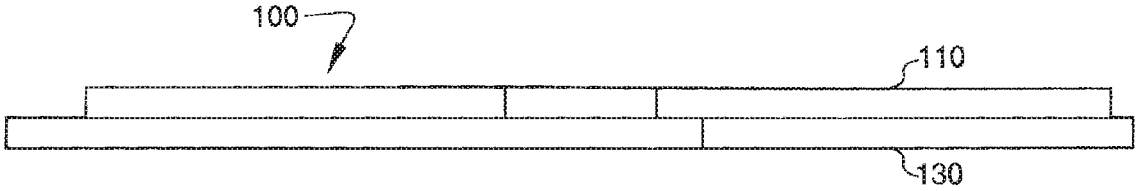
FIG. 1C is a plan view of the first embodiment, assembled.
Figure 1D:
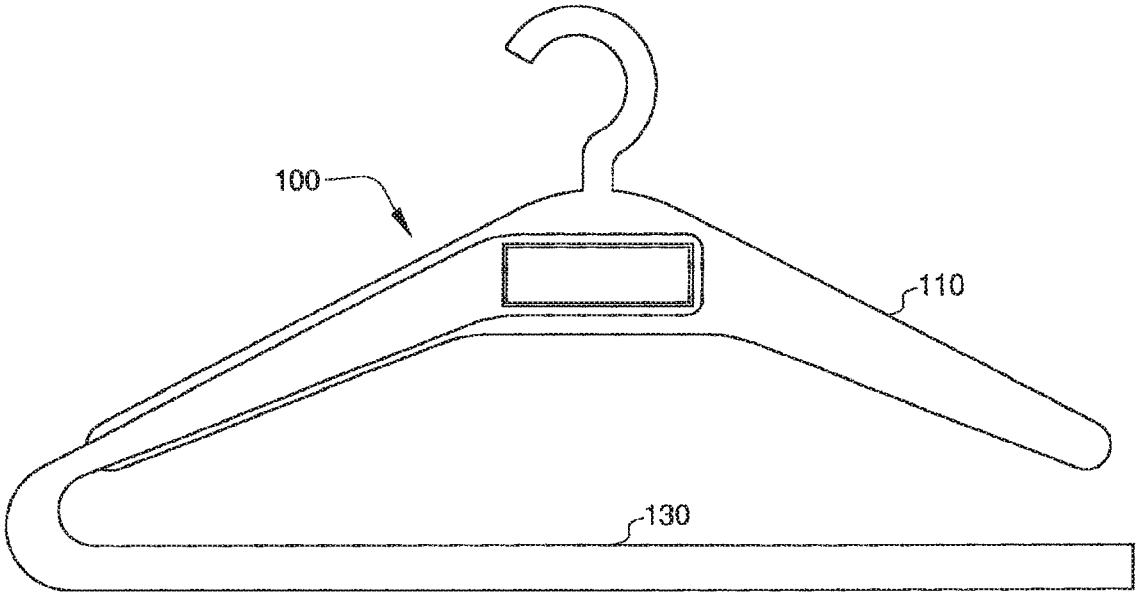
FIG. 1D is a front view of the first embodiment, assembled.
Figure 1E:
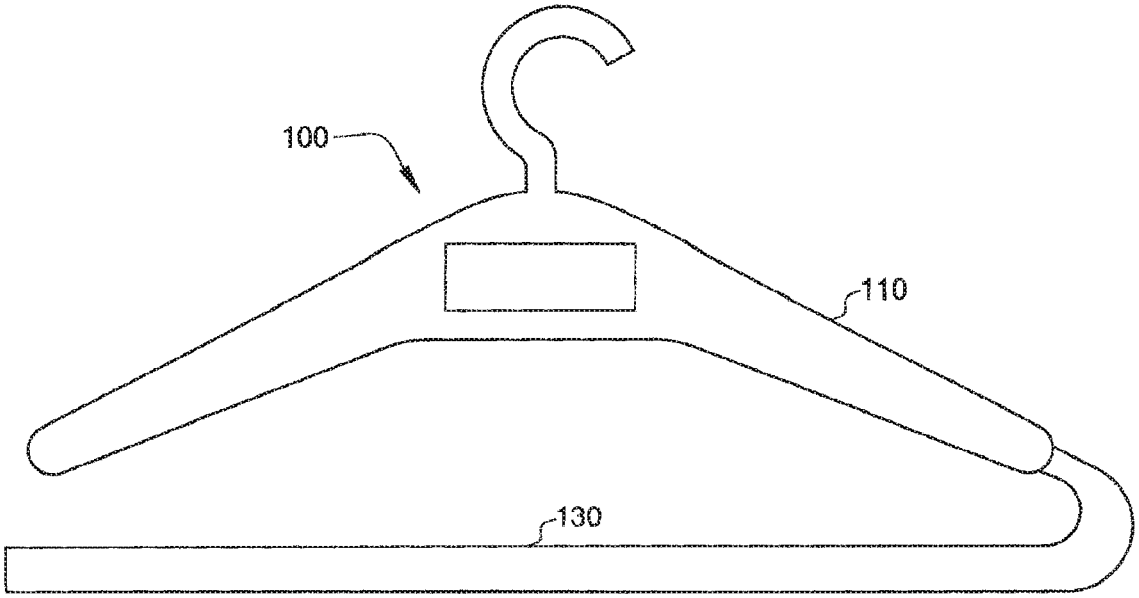
FIG. 1E is a back view of the first embodiment, assembled.
Figure 1F:
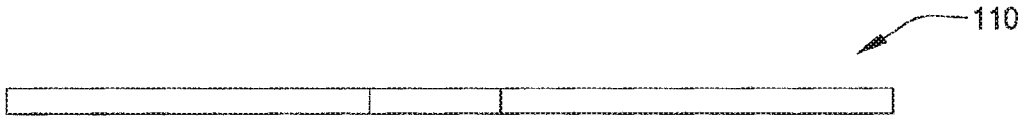
FIG. 1F is a plan view of the first embodiment, primary support.

The hanger 100 of these embodiments of the invention may be formed of any suitable material. For example, it may be molded of a reinforced or unreinforced plastic, for example polypropylene or glass reinforced nylon; or the hanger 100 may be 3-D printed of any suitable 3-D printing matrix material of suitable strength and durability. The resulting hanger should have a thin profile, as shown in the views of FIGS. 1C, 1D, and 1E.

FIGS. 1F, 1G, 1H, 1I, and 1J show further details of the primary support 110. The primary support 110 includes a hook in with a shank 112 for suspending the hanger 100, for example from a hanger bar in a closet. Arms 113A and 113B as previously described are constructed and arranged to support the top of a garment, for example by shoulders of the garment or straps.

Figure 1G:
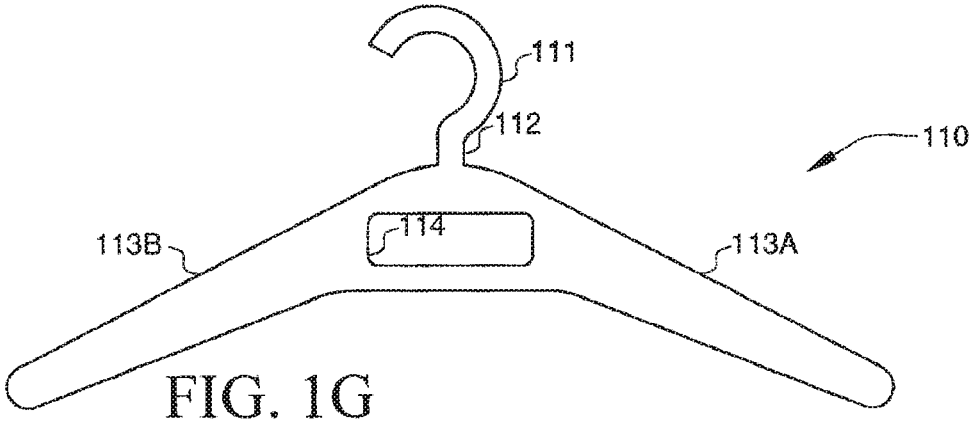
FIG. 1G is a front view of the first embodiment, primary support.
Figure 1H:
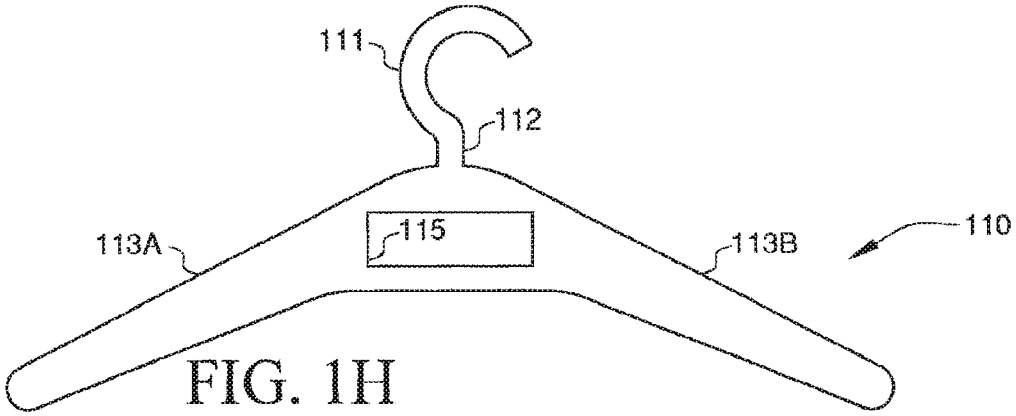
FIG. 1H is a back view of the first embodiment, primary support.
Figure 1I:
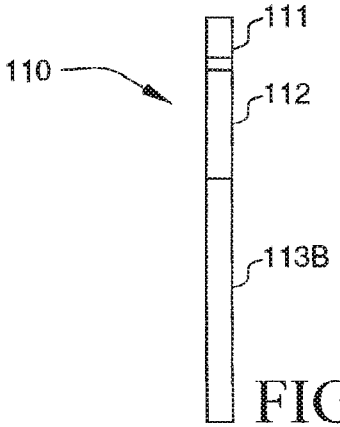
FIG. 1I is a right view of the first embodiment, primary support.
Figure 1J:
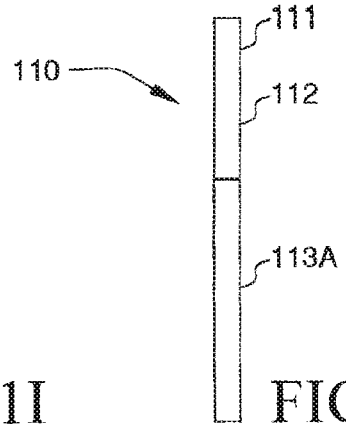
FIG. 1J is a left view of the first embodiment, primary support.
Figure 1K:
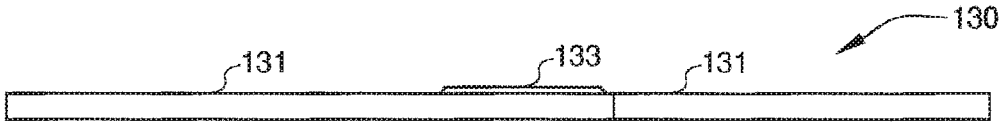
FIG. 1K is a plan view of the first embodiment, auxiliary support.
Figure 1L:
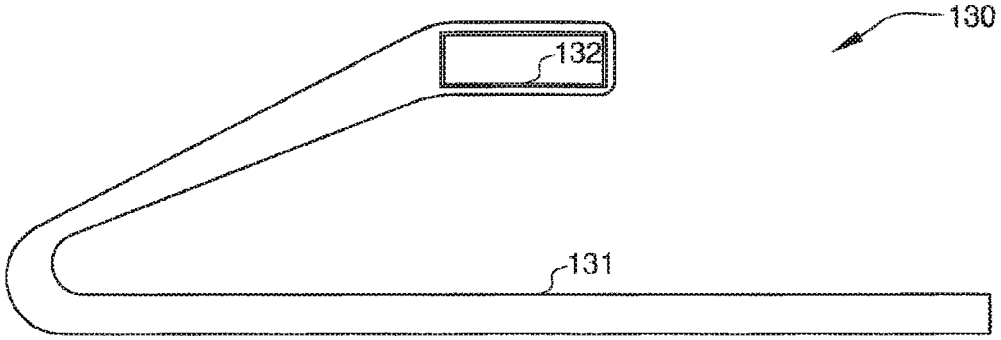
FIG. 1L is a front view of the first embodiment, auxiliary support.
Figure 1M:
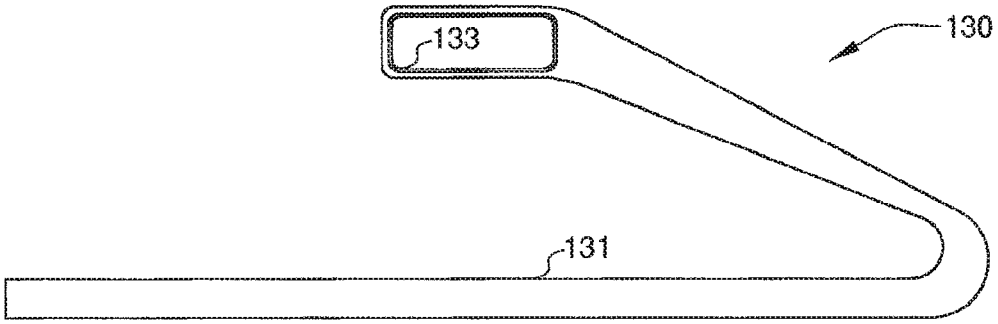
FIG. 1M is a back view of the first embodiment, auxiliary support.
Figure 1N:
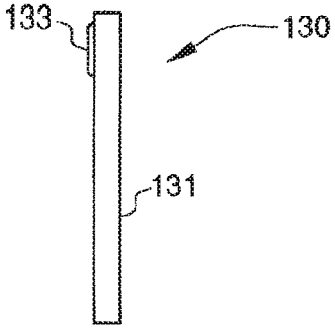
FIG. 1N is a right view of the first embodiment, auxiliary support.
Figure 1O:
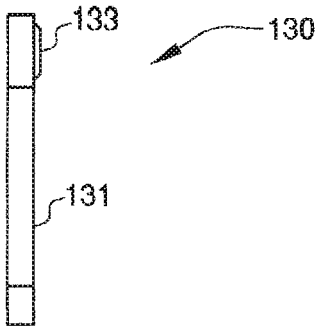
FIG. 1O is a left view of the first embodiment, auxiliary support.

The primary support 110 and the auxiliary support 130 have interlocking stepped shapes (FIG. 1G, 114; FIG. 1M, 133) forming a recess and key arrangement that help a user to align the supports 110 and 130 and also help prevent sheer forces from separating the supports 110 and 130 when a heavy garment might present unusually high sheer forces to them. This is explained further, below. The interlocking stepped shapes may correspond to the housing spaces (FIG. 1H, 115; FIG. 1L, 132) defined to hold magnet and/or steel elements used to separably retain supports 110 and 130 together, or may be pins or other shapes in overlapped portions of the primary support 110 and the auxiliary support 130.

Primary support 110 and the auxiliary support 130 include in recesses 115 and 132 an embedded or otherwise permanently affixed magnet and steel which attract each other with sufficient force to hold the primary support 110 and the auxiliary support 130 together when assembled, but which permit a user to separate easily by manually pulling them away from each other. In alternatives, the magnet and the steel may be swapped in location, two magnets may be held in recesses 115 and 132, or multiple combinations of magnets and/or steel elements may be placed in the same or other suitable locations. Proper alignment and resistance to sheer forces may be achieved by the strength and alignment of magnets encouraging proper natural alignment, or as next described, by the recess and key arrangement mentioned above.

Recess 114 is provided to help align with a matching key (FIG. 1M, 133), while a second recess 115 opposite to recess 114 on primary support 110 is provided to receive a magnet or metal element to provide an attractive force between primary support 110 and auxiliary support 130. Of course, in alternative embodiments, recess 114 may hold in its interior one of hook tape or loop tape, with the other held on the key (FIG. 1M, 133) to hold the primary support 110 and the auxiliary support 130 together. Suitable hook and loop tapes include Velcro® hook and loop tapes (a brand of hook and loop fastener tapes available from Velcro Companies, Manchester, NH) and other similar fasteners. Similar fasteners include, but are not limited to, variants such as mushroom tapes and other heavy duty alternatives such as Dual Lock® (a brand of fastener tape available from 3M Corporation) and Duotec® (a brand of fastener tape available from Gottlieb Binder GmbH & Co. KG).

FIGS. 1K, 1L, 1M, 1N, and 1O show further details of the auxiliary support 130. The auxiliary support 130 further includes the bar 131 for supporting the lower portion of a long garment, a recess 132 for holding the mating element to the magnet or metal held in recess 115 of the primary support 110, and a key 133 extending out of the surface of auxiliary support 130 to help align the auxiliary support 130 with primary support 110 by fitting in recess 114 of primary support 110. The bar 131 may have a diameter, covering and/or surface quality suitable for retaining the type of garment for which the hanger is to be used.

Figure 2A:
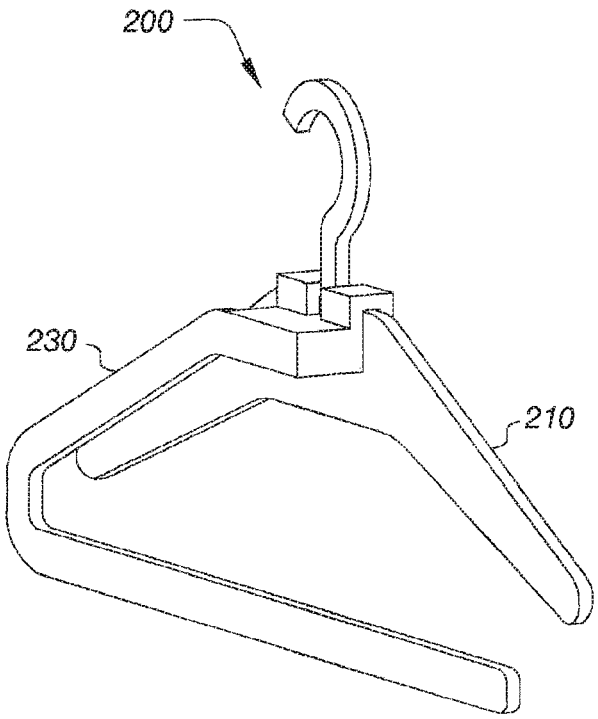
FIG. 2A is an axonometric view of a second embodiment of the hanger, assembled.
Figure 2B:
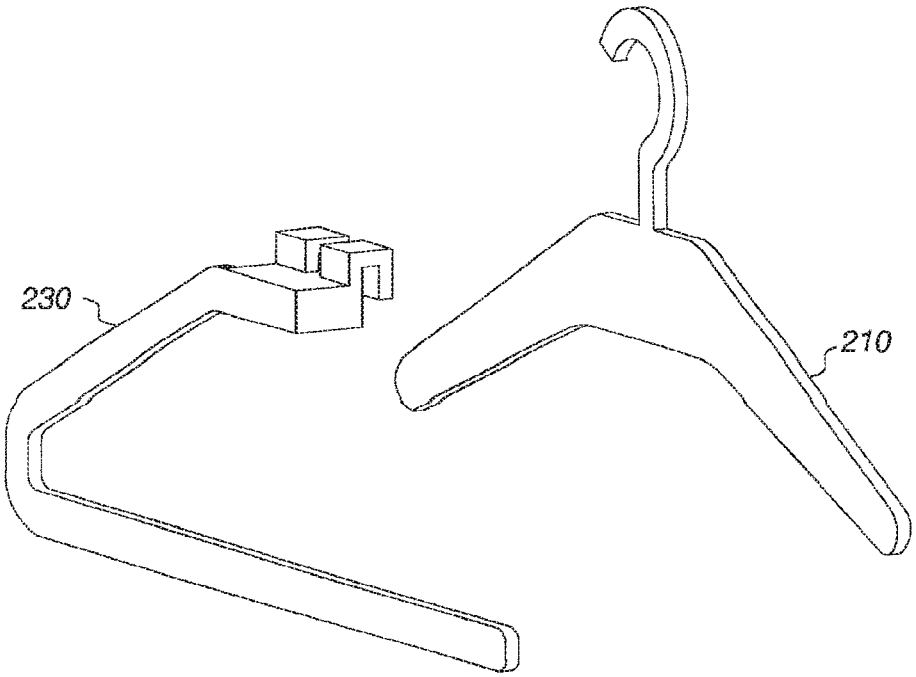
FIG. 2B is an axonometric view of the second embodiment, disassembled.
Figure 2C:
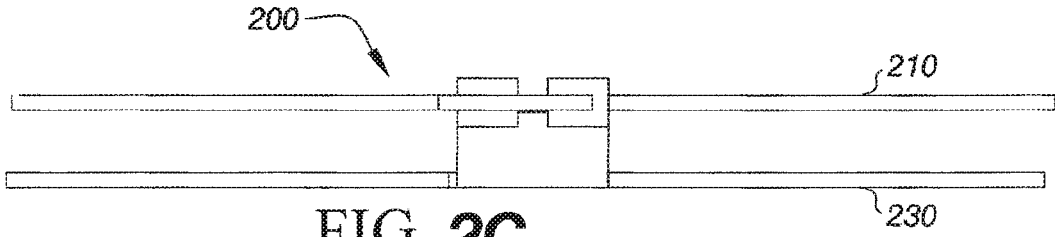
FIG. 2C is a plan view of the second embodiment, assembled.
Figure 2D:
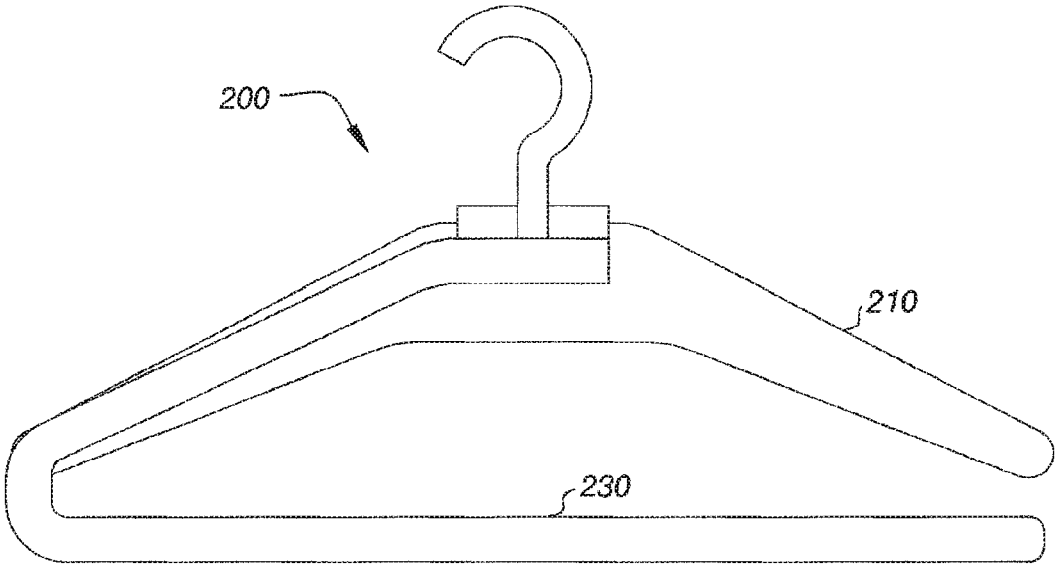
FIG. 2D is a front view of the second embodiment, assembled.
Figure 2E:
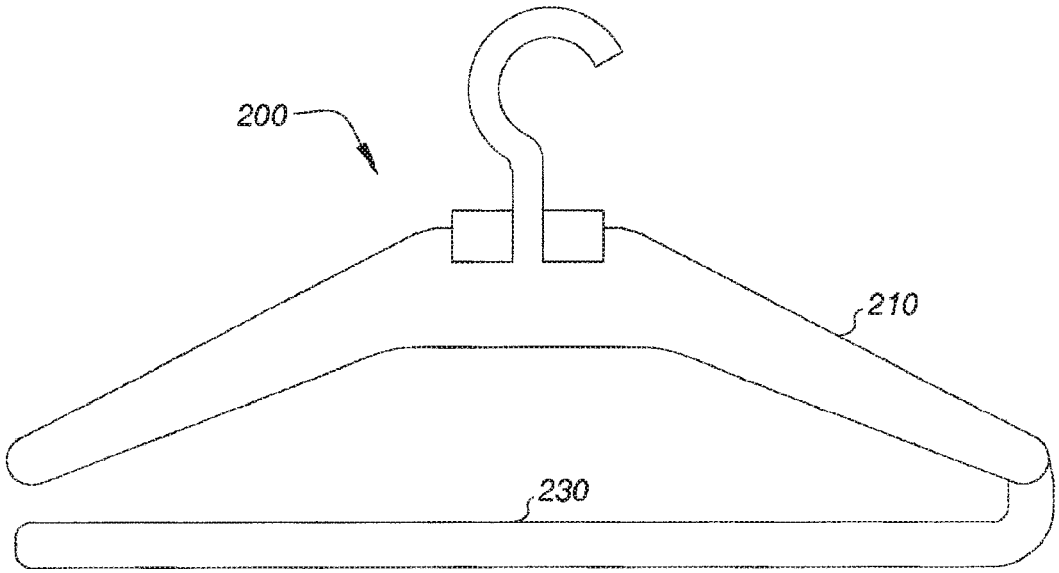
FIG. 2E is a back view of the second embodiment, assembled.
Figure 2F:
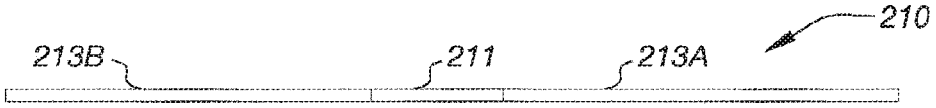
FIG. 2F is a plan view of the second embodiment, primary support.
Figure 2G:
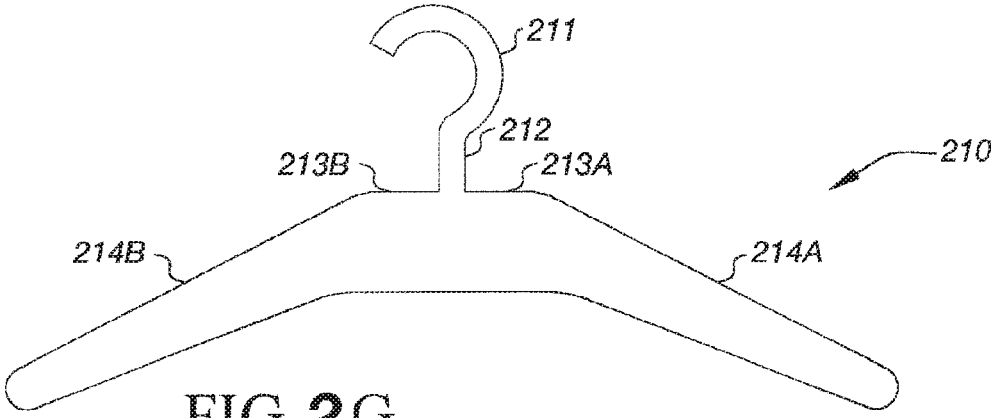
FIG. 2G is a front view of the second embodiment, primary support.
Figure 2H:
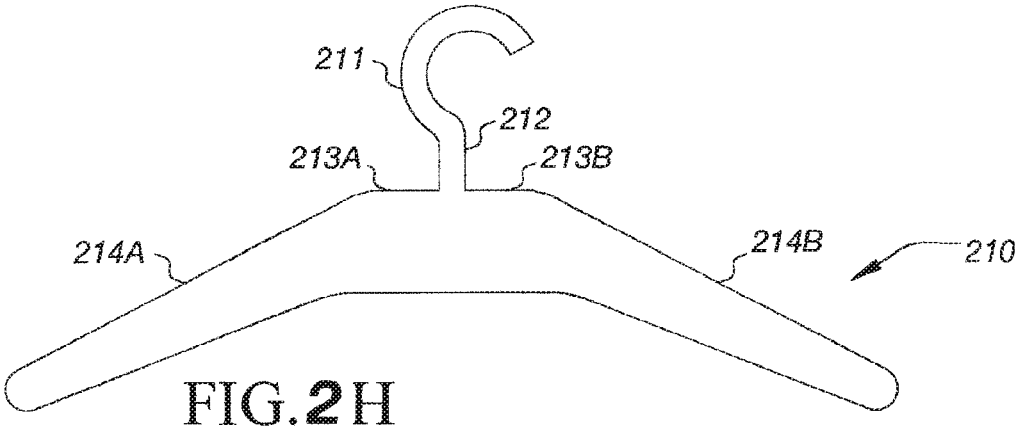
FIG. 2H is a back view of the second embodiment, primary support.
Figure 2I:
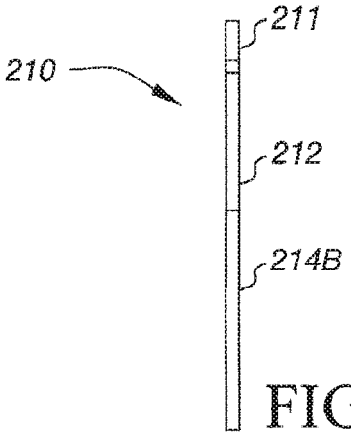
FIG. 2I is a right view of the second embodiment, primary support.
Figure 2J:
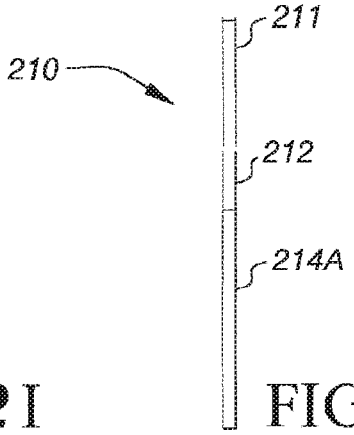
FIG. 2J is a left view of the second embodiment, primary support.
Figure 2K:
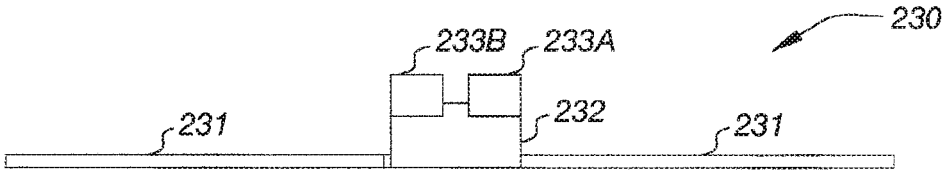
FIG. 2K is a plan view of the second embodiment, auxiliary support.
Figure 2L:
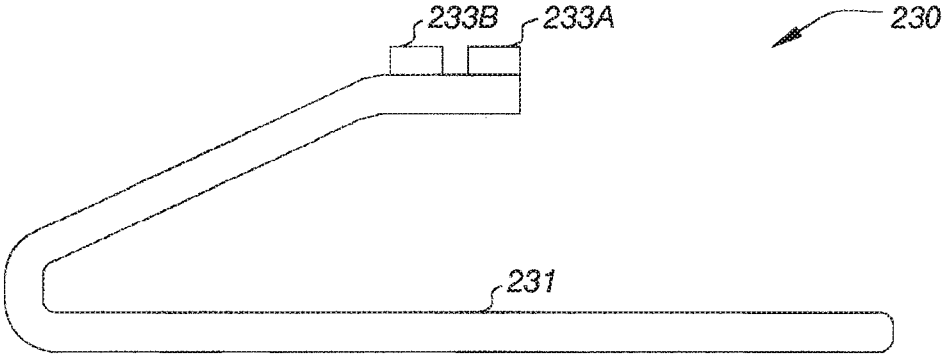
FIG. 2L is a front view of the second embodiment, auxiliary support.
Figure 2M:
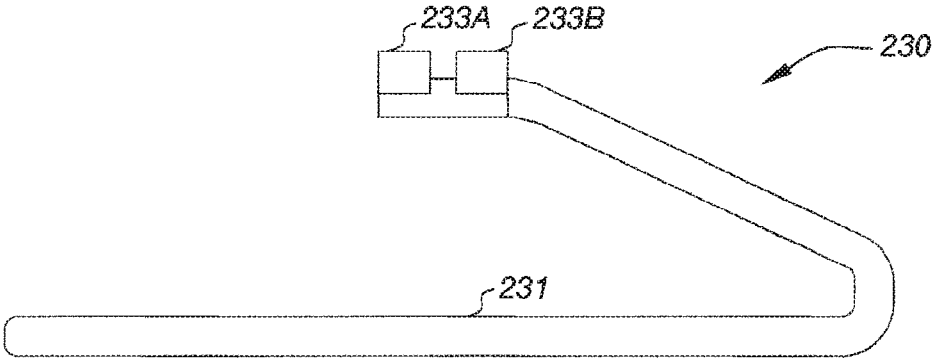
FIG. 2M is a back view of the second embodiment, auxiliary support.
Figure 2N:
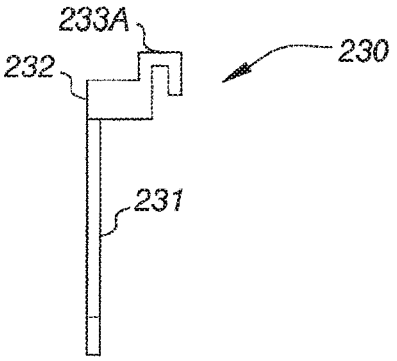
FIG. 2N is a right view of the second embodiment, auxiliary support.
Figure 2O:
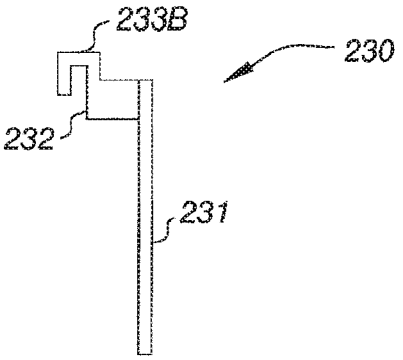
FIG. 2O is a left view of the second embodiment, auxiliary support.

Embodiments of the invention with a different means of attaching an auxiliary support 230 to a primary support 210 are illustrated in FIGS. 2A-2O.

Referring to FIG. 2A, a hanger 200 is shown having a primary support 210 for supporting a garment at its shoulders, shoulder straps, or other topmost portion; and an auxiliary support 230 for supporting a garment at its hems, cuffs, or other lowermost portion. The auxiliary support 230 includes hooks 233A and 233B that hook over the shoulders 214A and 214B of the arms 213A and 213B of primary support 210 (see, FIGS. 2F-2O), as explained further, below.

FIG. 2A shows the hanger 200 assembled in the configuration for storing a garment; FIG. 2B shows the hanger 200 separated into the primary support 210 and the auxiliary support 230. In this embodiment, the auxiliary support 230 simply unhooks from the primary support 210.

The hanger 200 of these embodiments of the invention may also be formed of any suitable material.

FIGS. 2F, 2G, 2H, 2I, and 2J show further details of the primary support 210. The primary support 210 includes a hook 211 with a shank 212 for suspending the hanger 200 from a hanger bar in a closet. Arms 214A and 214B extend out to support a garment from shoulders or straps. Arms 214A and 214B have shoulders 213A and 213B, respectively, to support hooks extending from auxiliary support 230 as explained below.

FIGS. 2K, 2L, 2M, 2N, and 2O show further details of the auxiliary support 230. The auxiliary support 230 includes the bar 231 for supporting the lower portion of a long garment. The auxiliary support 230 further has hooks 233A and 233B supported from a shank 232 positioning hooks 233A and 233B to hang auxiliary support 230 from primary support 210. The bar 231 may have a diameter, covering and/or surface quality suitable for retaining the type of garment for which the hanger is to be used.

Figure 3A:
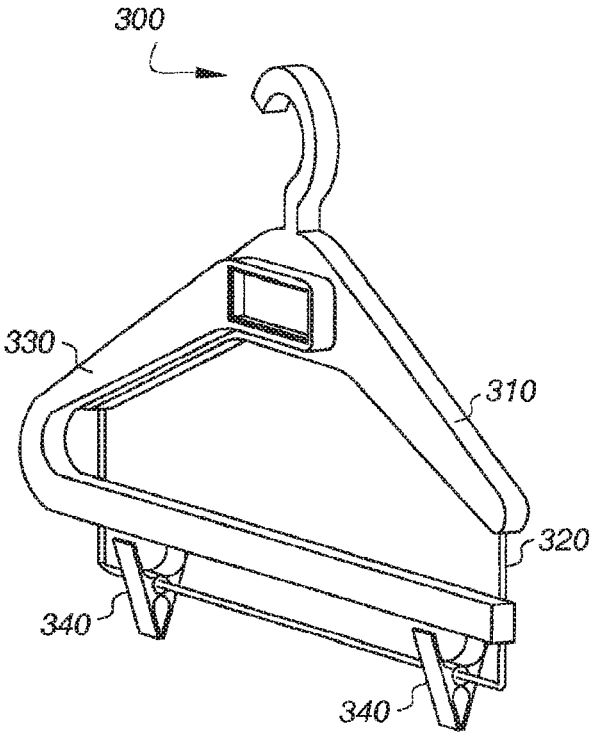
FIG. 3A is an axonometric view of a third embodiment of the hanger, assembled.
Figure 3B:
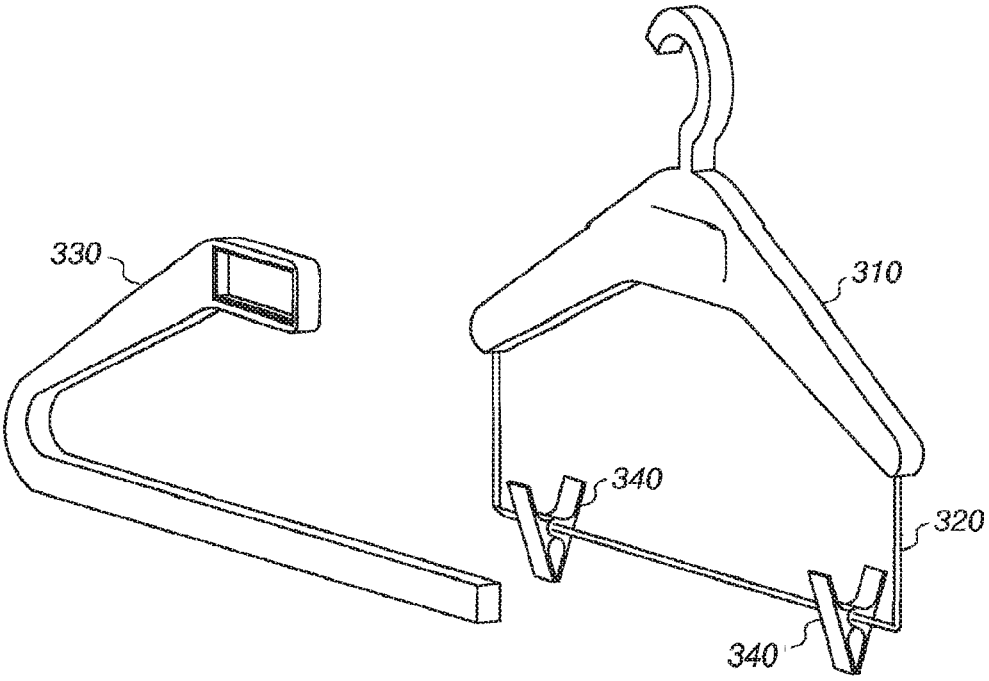
FIG. 3B is an axonometric view of the third embodiment, disassembled.
Figure 3C:
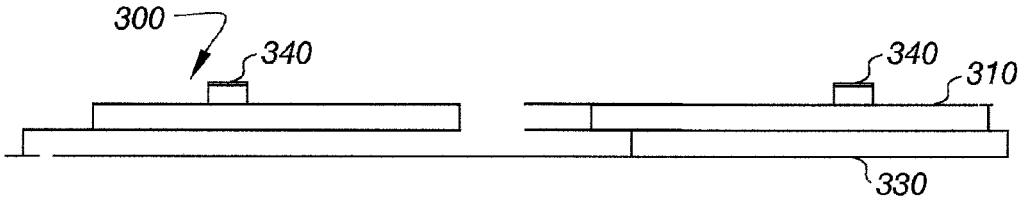
FIG. 3C is a plan view of the third embodiment, assembled.
Figure 3D:
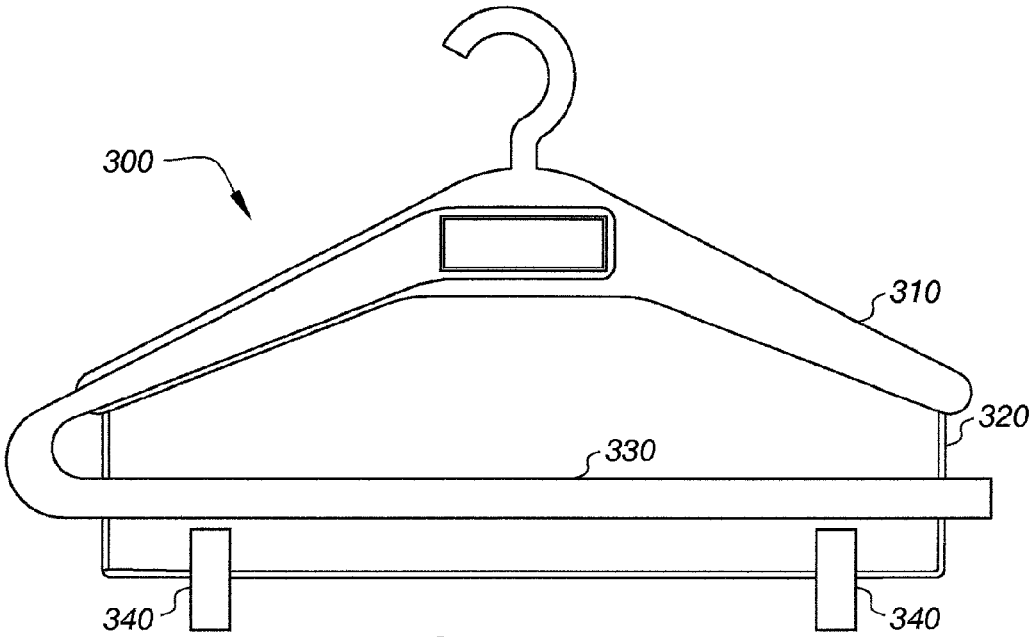
FIG. 3D is a front view of the third embodiment, assembled.
Figure 3E:
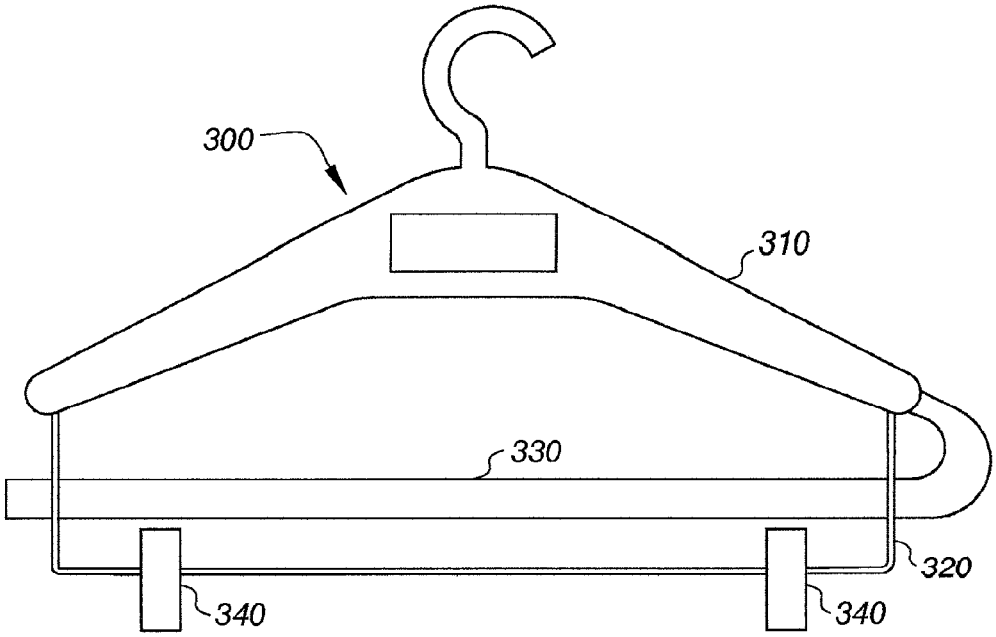
FIG. 3E is a back view of the third embodiment, assembled.
Figure 3F:
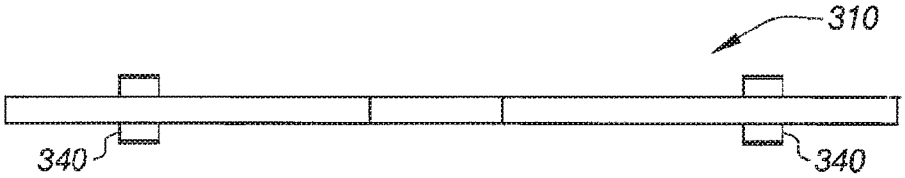
FIG. 3F is a plan view of the third embodiment, primary support.
Figure 3G:
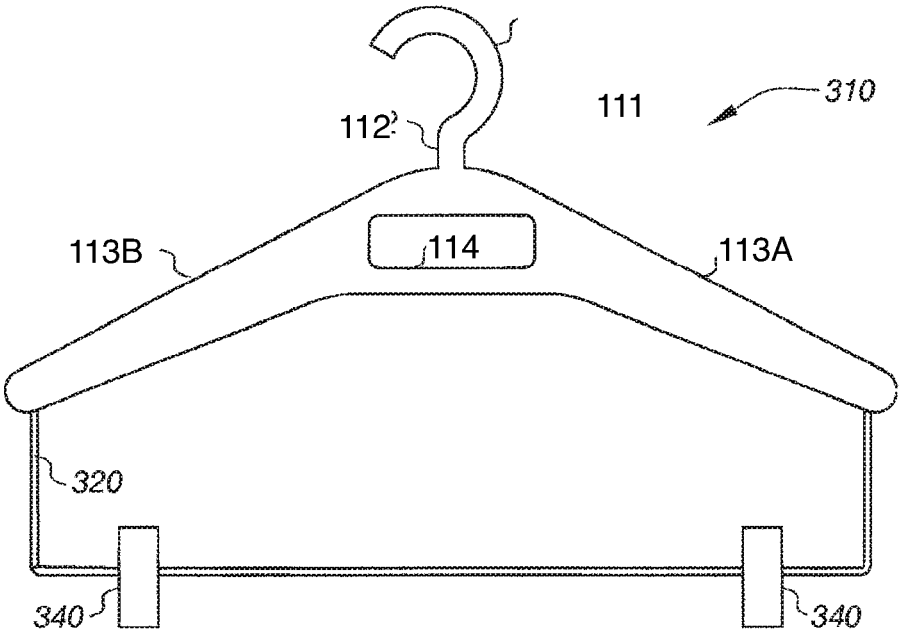
FIG. 3G is a front view of the third embodiment, primary support.
Figure 3H:
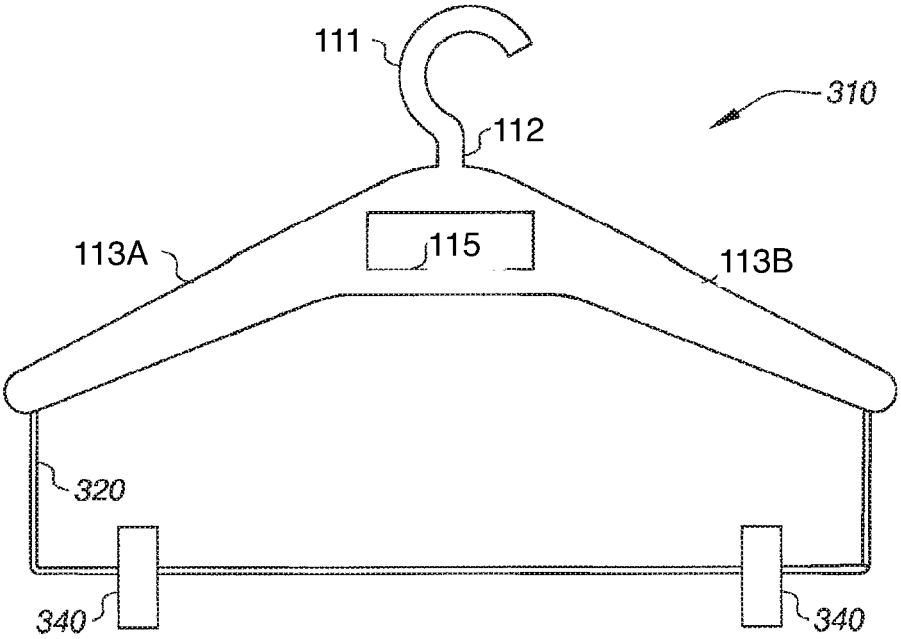
FIG. 3H is a back view of the third embodiment, primary support.
Figure 3I:
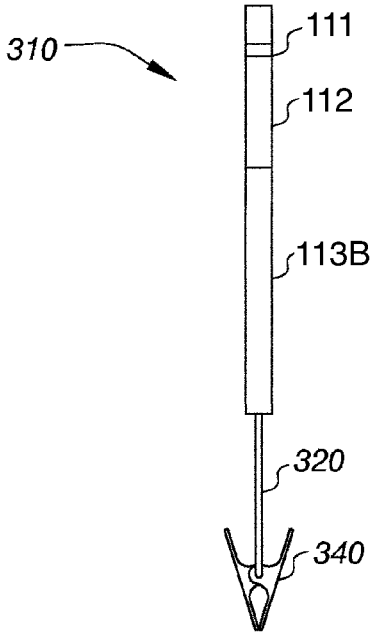
FIG. 3I is a right view of the third embodiment, primary support.
Figure 3J:
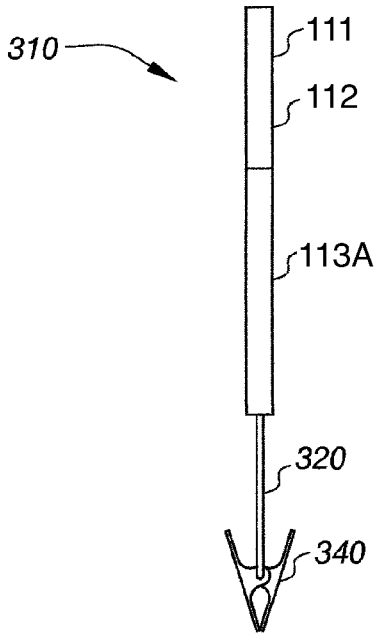
FIG. 3J is a left view of the third embodiment, primary support.
Figure 3K:
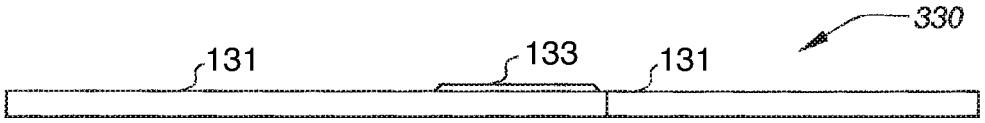
FIG. 3K is a plan view of the third embodiment, auxiliary support.
Figure 3L:
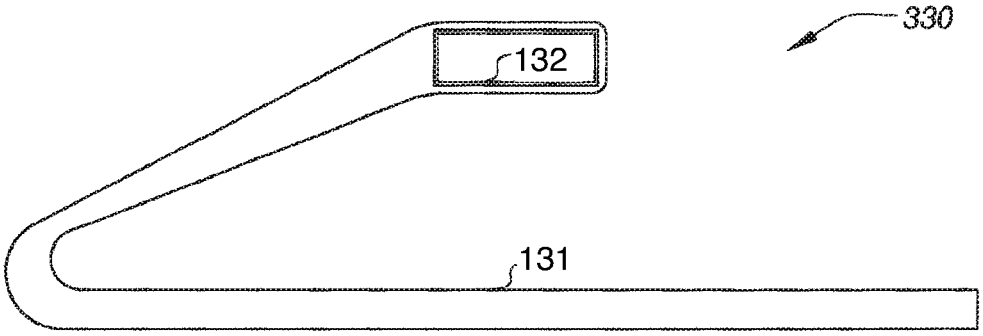
FIG. 3L is a front view of the third embodiment, auxiliary support.
Figure 3M:
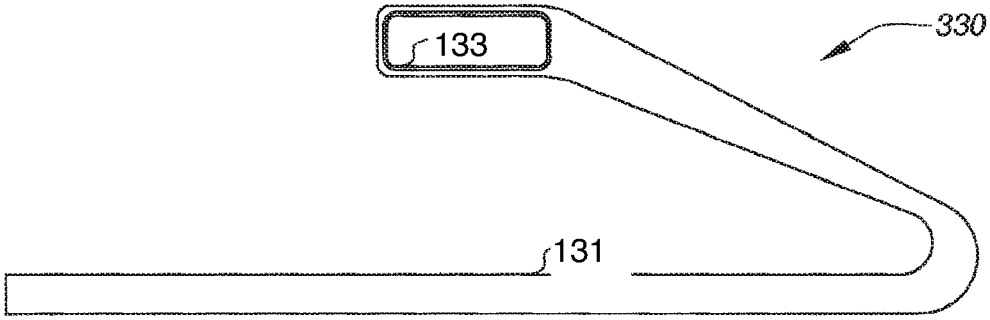
FIG. 3M is a back view of the third embodiment, auxiliary support.
Figure 3N:
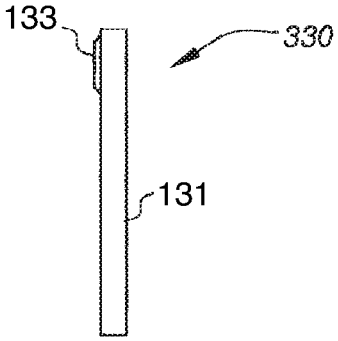
FIG. 3N is a right view of the third embodiment, auxiliary support.
Figure 3O:
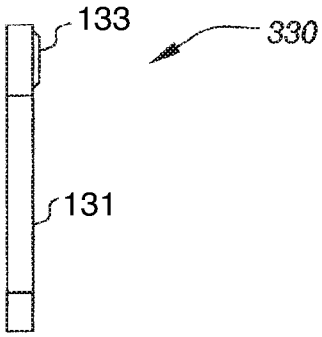
FIG. 3O is a left view of the third embodiment, auxiliary support.

Embodiments of the invention with a clip bar 320 and clips 340 for garments such as long skirts or that include such pieces that do not have elements suitable for hanging from arms of primary support 310 are illustrated in FIGS. 3A-3O.

Referring to FIG. 3A, a hanger 300 is shown having a primary support 310 for supporting a garment at its shoulders, shoulder straps, or other topmost portion, but add a clip bar 320 and clips 340 to support a skirt or similar garment, for example at its waist; and an auxiliary support 330 for supporting a garment at its hems, cuffs, or other lowermost portion. As shown in FIGS. 3A-3O, this embodiment is otherwise similar to that described and shown in connection with FIGS. 1A-1O. The clip bar 320 may be fastened into the primary support 310 by any suitable means. For example, the primary support 310 may be molded around ends of clip bar 320, or the clip bar 320 may have ends otherwise embedded in the primary support 310, adhered to the primary support, or fastened to the primary support.

Figure 4A:
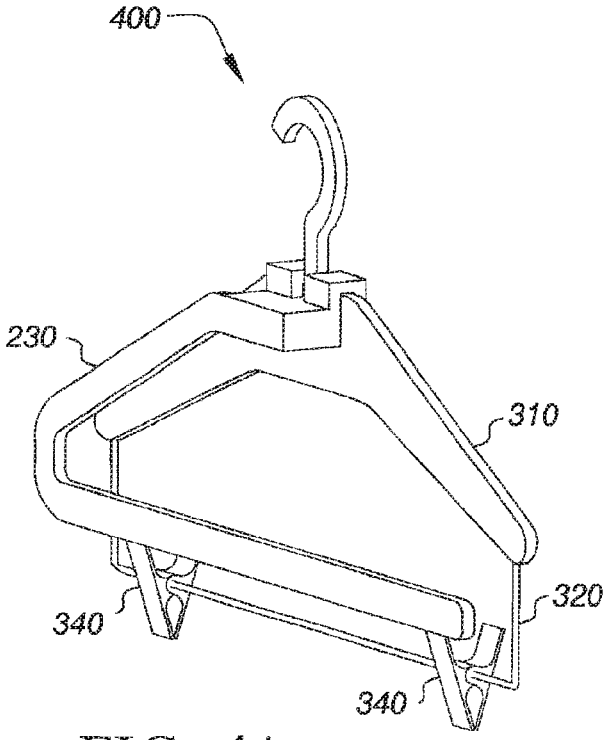
FIG. 4A is an axonometric view of a fourth embodiment of the hanger, assembled.
Figure 4B:
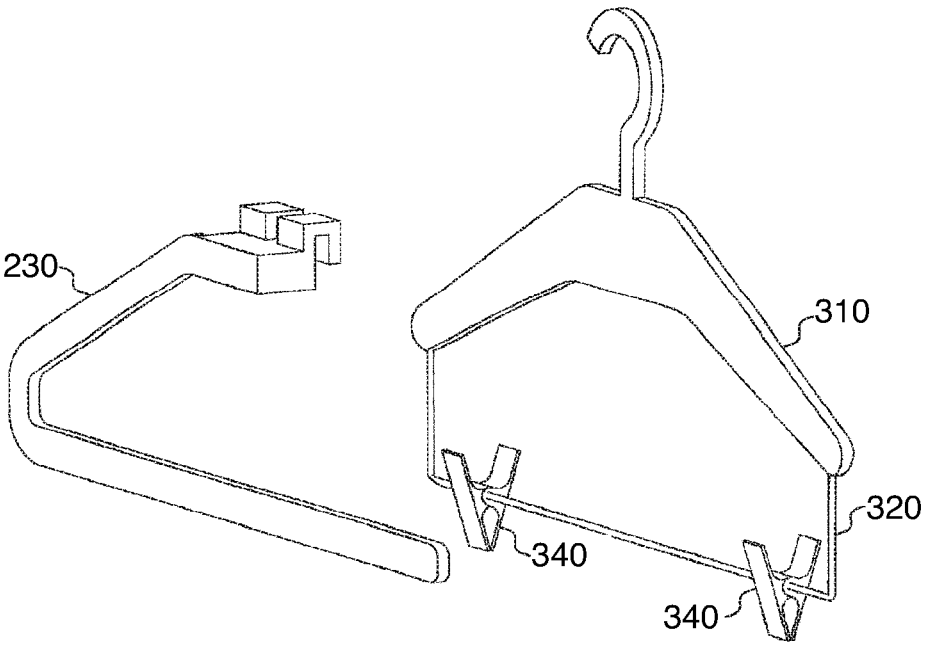
FIG. 4B is an axonometric view of the fourth embodiment, disassembled.
Figure 4C:
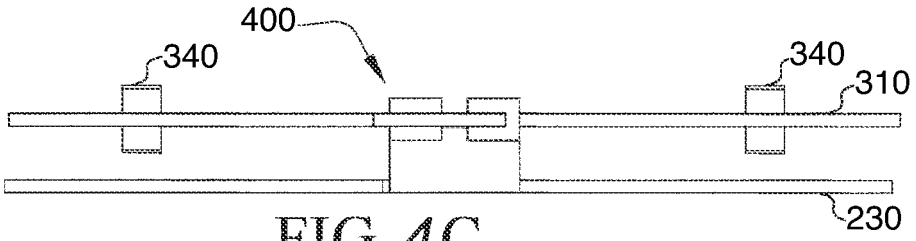
FIG. 4C is a plan view of the fourth embodiment, assembled.
Figure 4D:
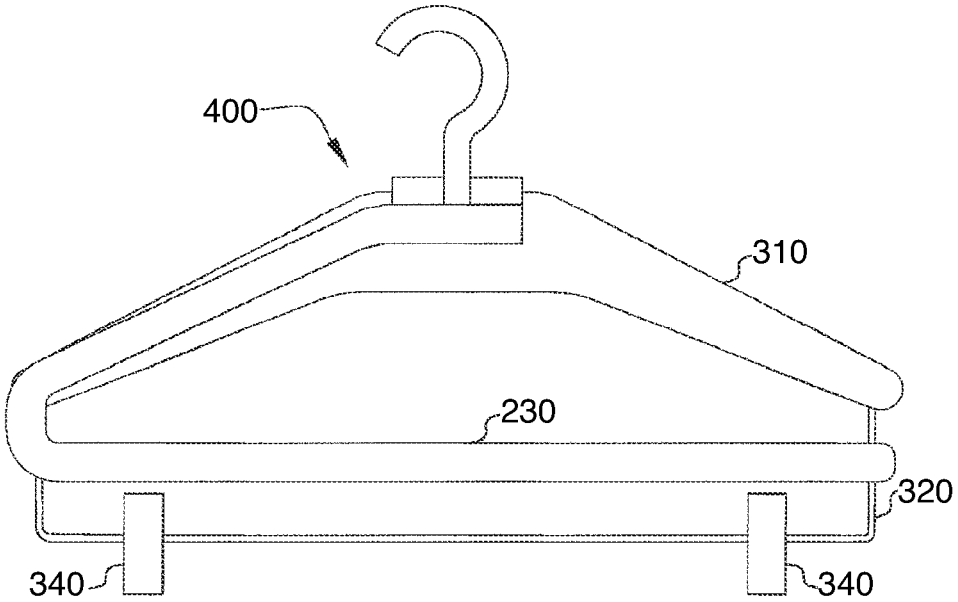
FIG. 4D is a front view of the fourth embodiment, assembled.
Figure 4E:
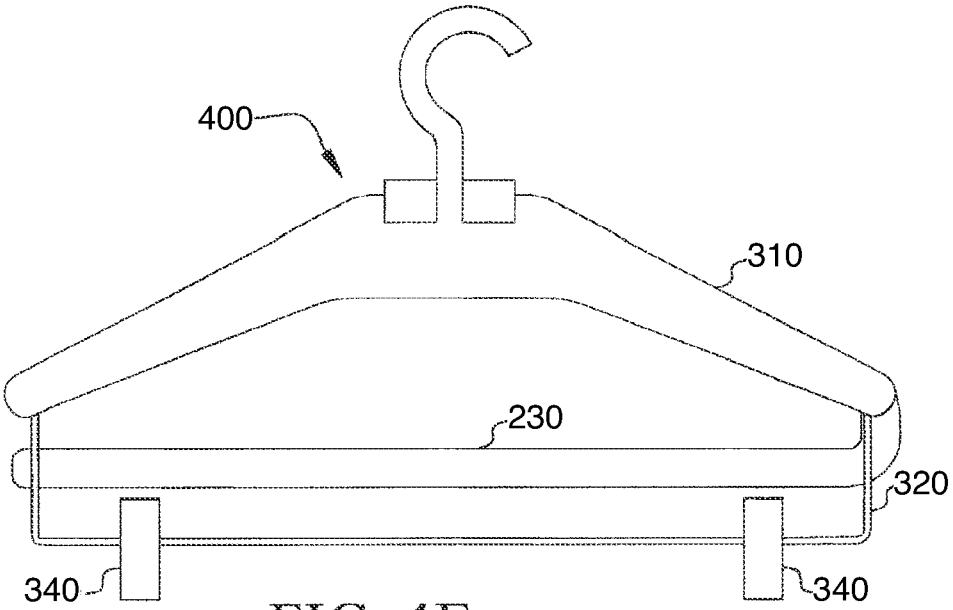
FIG. 4E is a back view of the fourth embodiment, assembled.
Figure 4F:
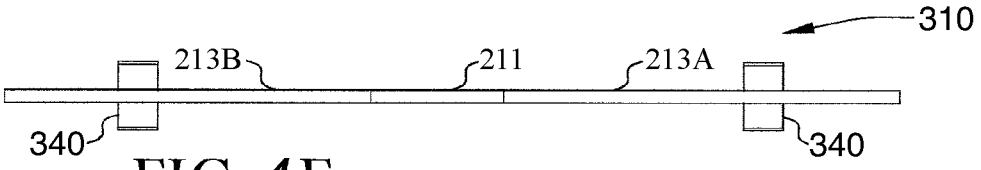
FIG. 4F is a plan view of the fourth embodiment, primary support.
Figure 4G:
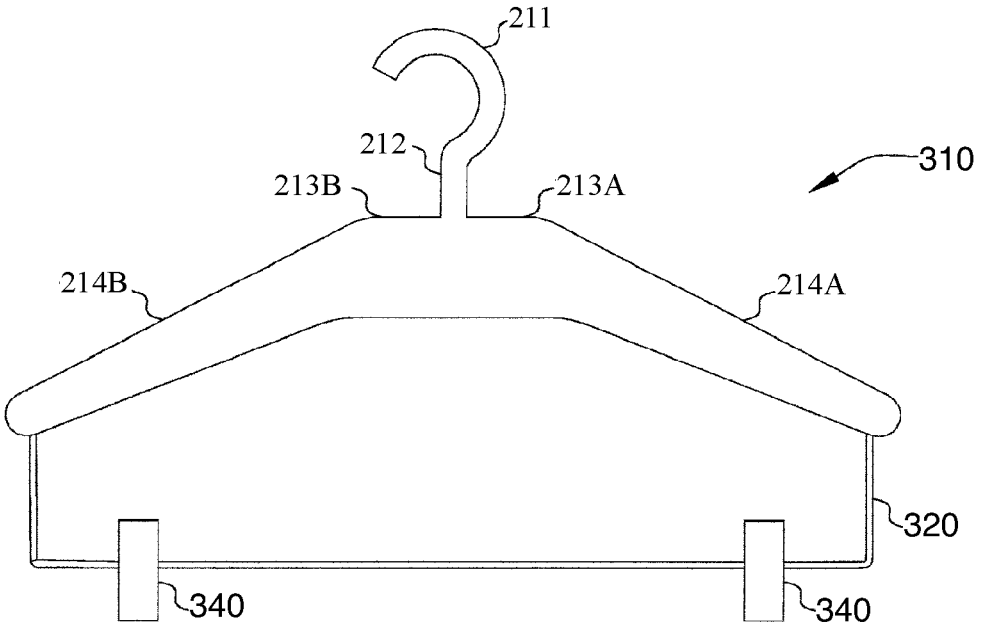
FIG. 4G is a front view of the fourth embodiment, primary support.
Figure 4H:
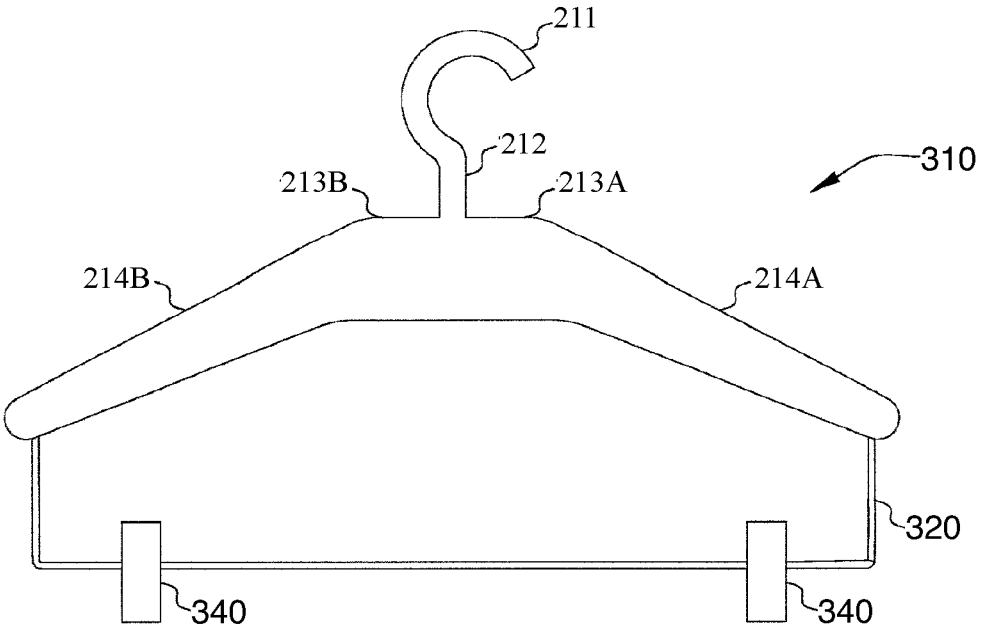
FIG. 4H is a back view of the fourth embodiment, primary support.
Figure 4I:
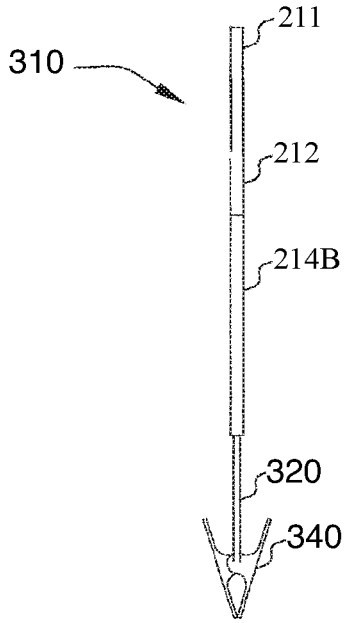
FIG. 4I is a right view of the fourth embodiment, primary support.
Figure 4J:
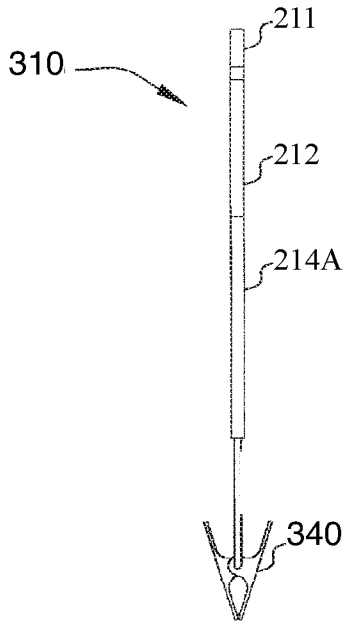
FIG. 4J is a left view of the fourth embodiment, primary support.
Figure 4K:
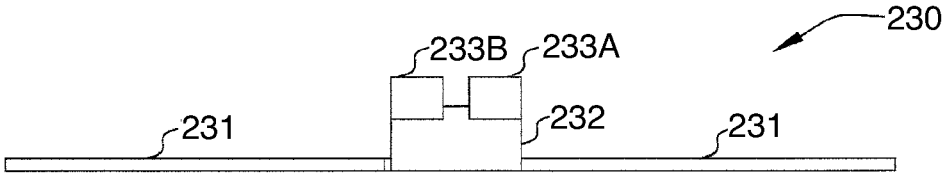
FIG. 4K is a plan view of the fourth embodiment, auxiliary support.
Figure 4L:
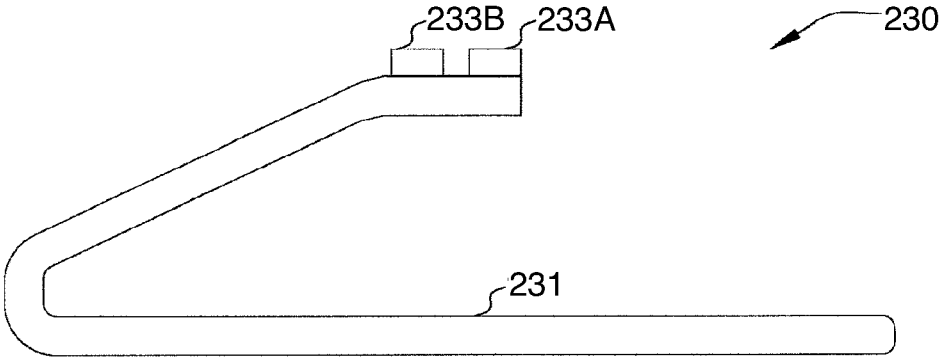
FIG. 4L is a front view of the fourth embodiment, auxiliary support.
Figure 4M:
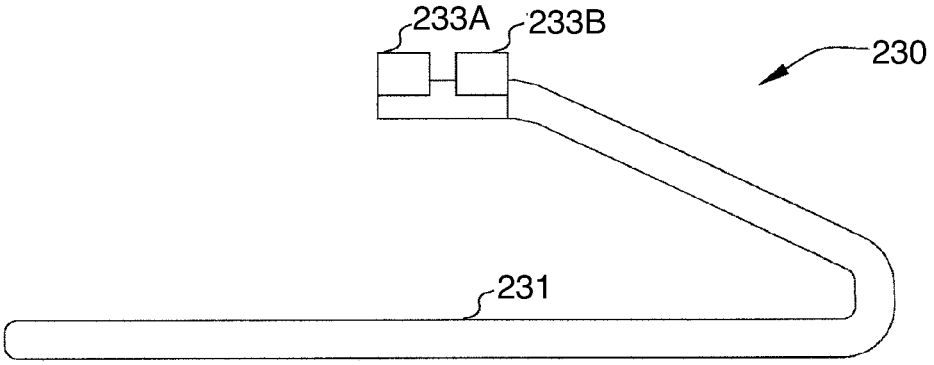
FIG. 4M is a back view of the fourth embodiment, auxiliary support.
Figure 4N:
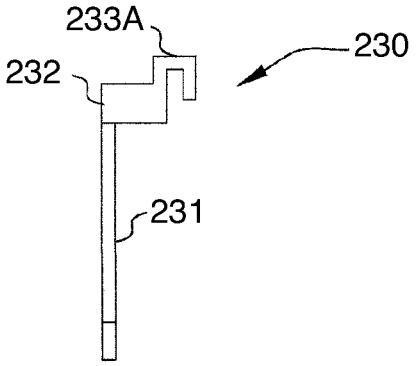
FIG. 4N is a right view of the fourth embodiment, auxiliary support.
Figure 4O:
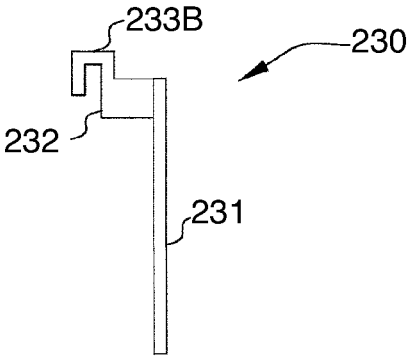
FIG. 4O is a left view of the fourth embodiment, auxiliary support.

FIGS. 4A-4O illustrate how elements of the embodiment of FIGS. 2A-2O are combinable with elements of the embodiments of FIGS. 3A-3O.

Referring to FIG. 4A, a hanger 400 is shown having a primary support 310 for supporting a garment at its shoulders, shoulder straps, or other topmost portion; and an auxiliary support 230 for supporting a garment at its hems, cuffs, or other lowermost portion. This embodiment combines the auxiliary support structure having hooks 233A and 233B supported from a shank 232 illustrated by the embodiment shown in FIGS. 2A-2O with the primary support structure having a clip bar 320 and clips 34*o* illustrated by the embodiment shown in FIGS. 3A-3O. The attachment and detachment of the primary support 310 and the auxiliary support 230 is as described in connection with FIGS. 2A-2O, while the support of the garment is as described in connection with FIGS. 3A-3O.

Figure 5A:
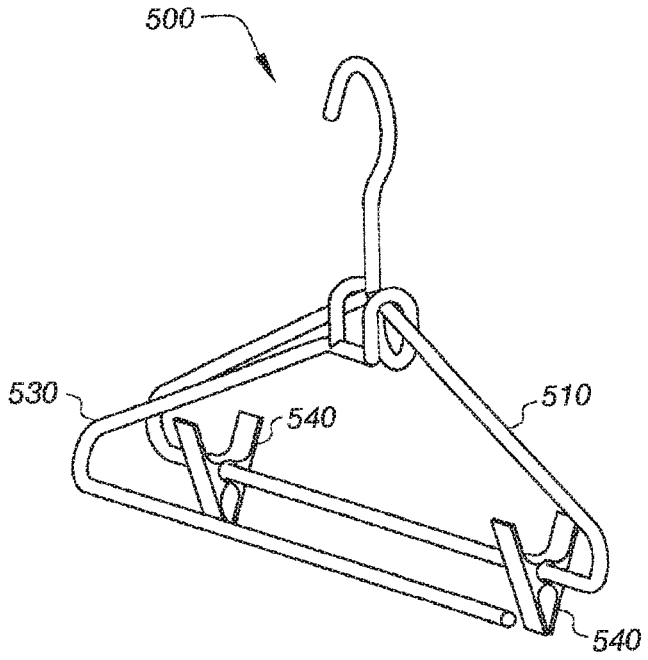
FIG. 5A is an axonometric view of a fourth embodiment of the hanger, assembled.
Figure 5B:
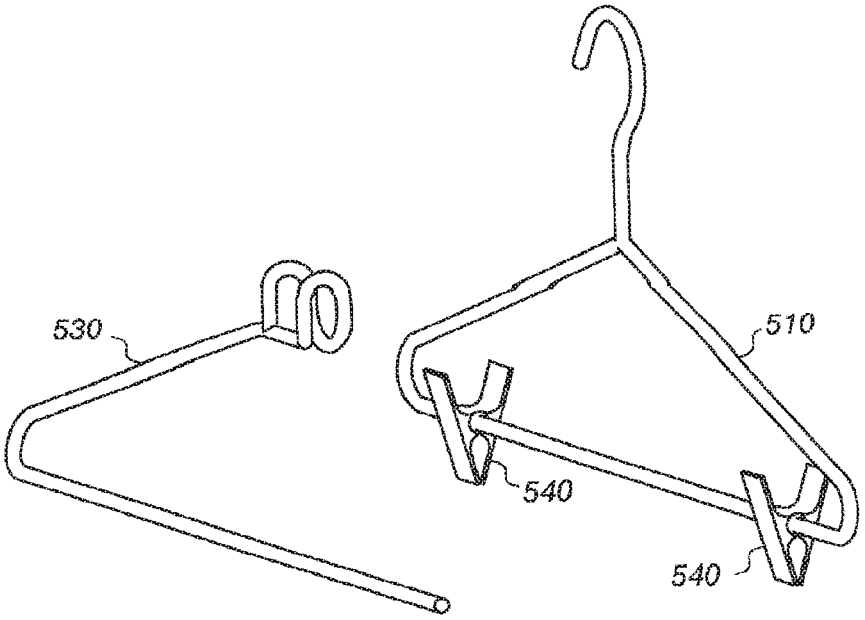
FIG. 5B is an axonometric view of the fourth embodiment, disassembled.
Figure 5C:
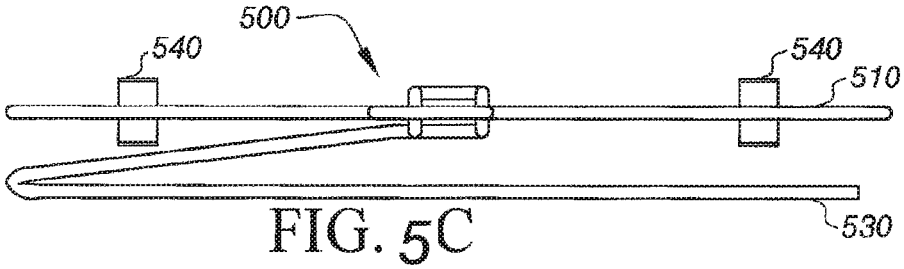
FIG. 5C is a plan view of the fourth embodiment, assembled.
Figure 5D:
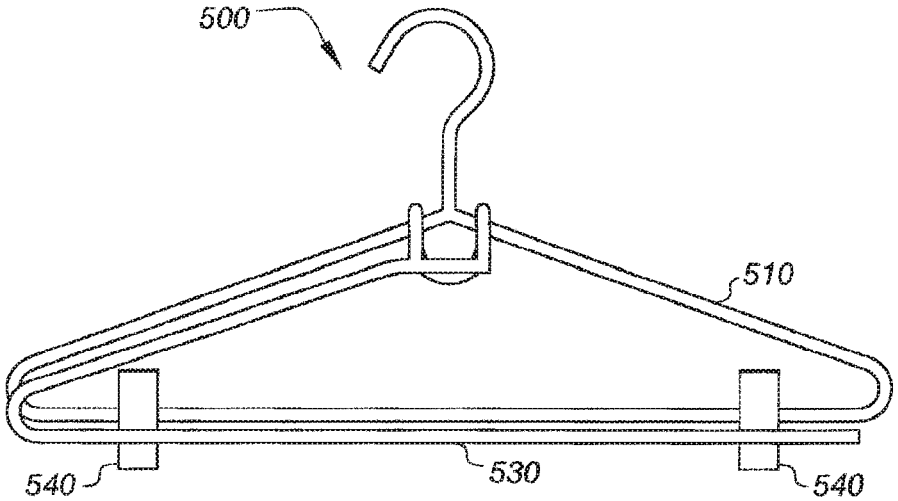
FIG. 5D is a front view of the fourth embodiment, assembled.
Figure 5E:
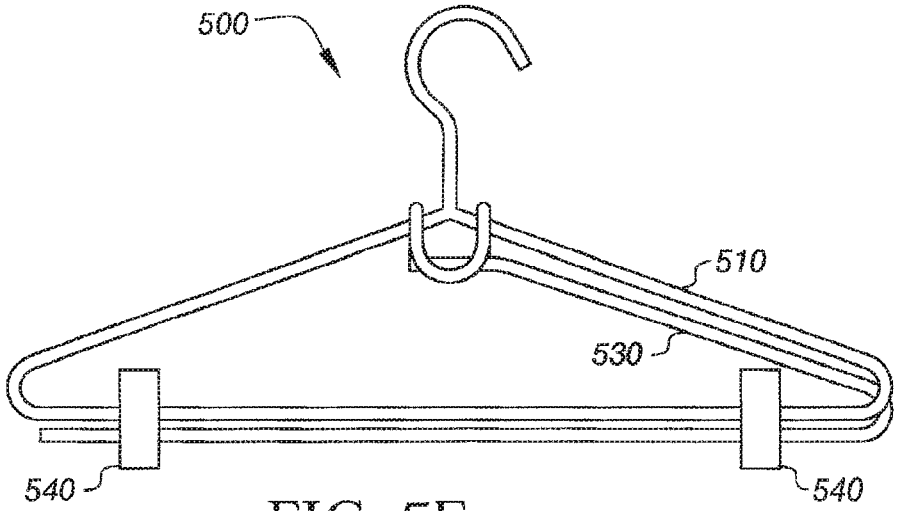
FIG. 5E is a back view of the fourth embodiment, assembled.
Figure 5F:
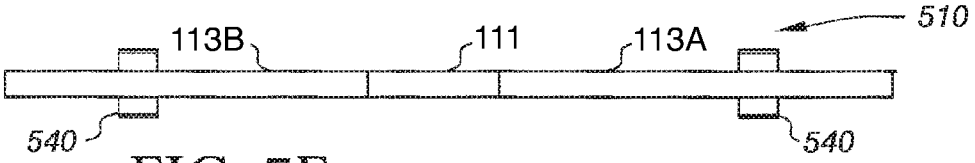
FIG. 5F is a plan view of the fourth embodiment, primary support.
Figure 5G:
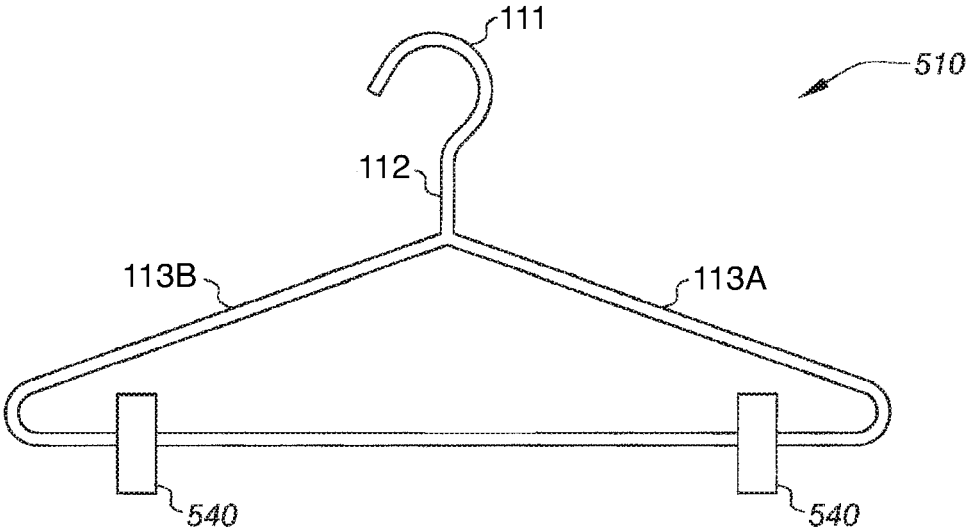
FIG. 5G is a front view of the fourth embodiment, primary support.
Figure 5H:
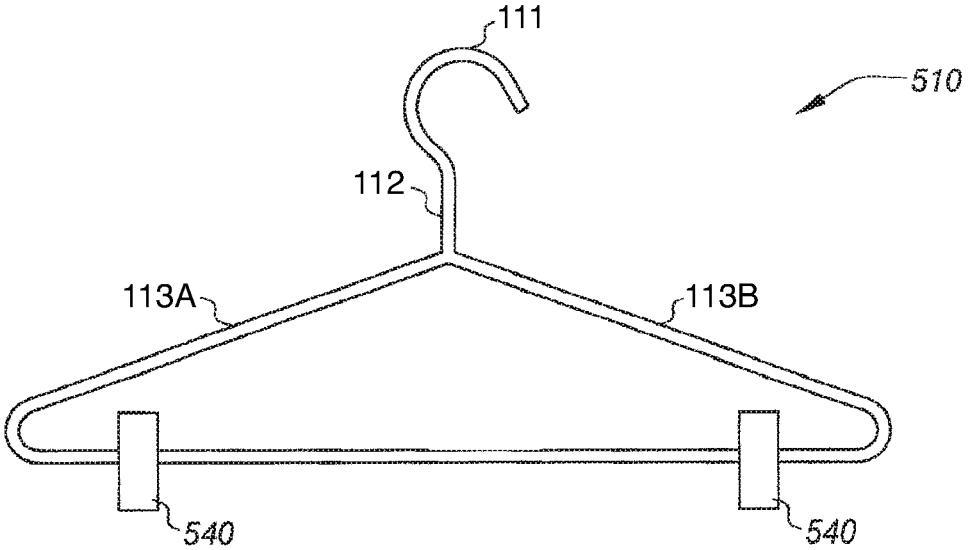
FIG. 5H is a back view of the fourth embodiment, primary support.
Figure 5I:
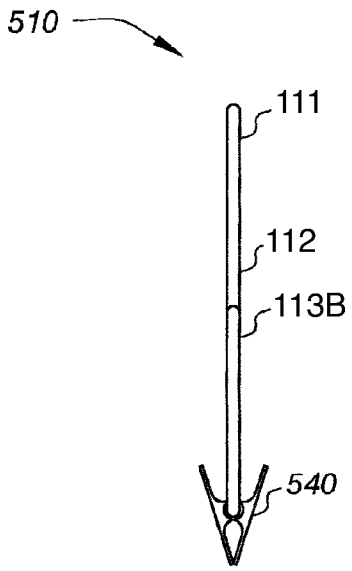
FIG. 5I is a right view of the fourth embodiment, primary support.
Figure 5J:
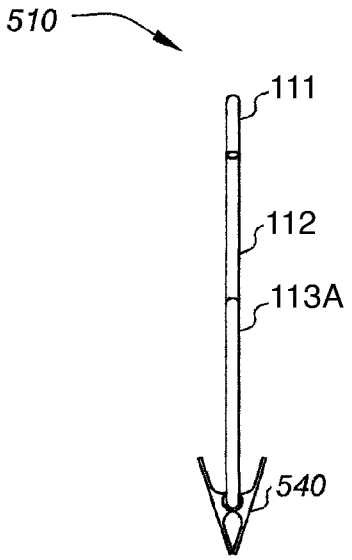
FIG. 5J is a left view of the fourth embodiment, primary support.
Figure 5K:
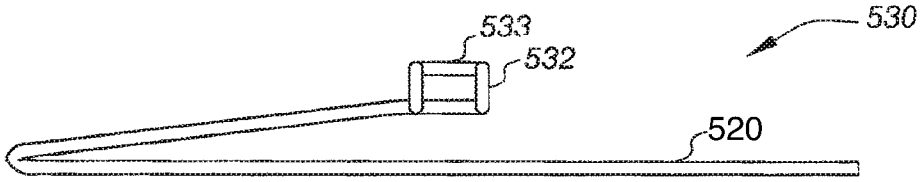
FIG. 5K is a plan view of the fourth embodiment, auxiliary support.
Figure 5L:
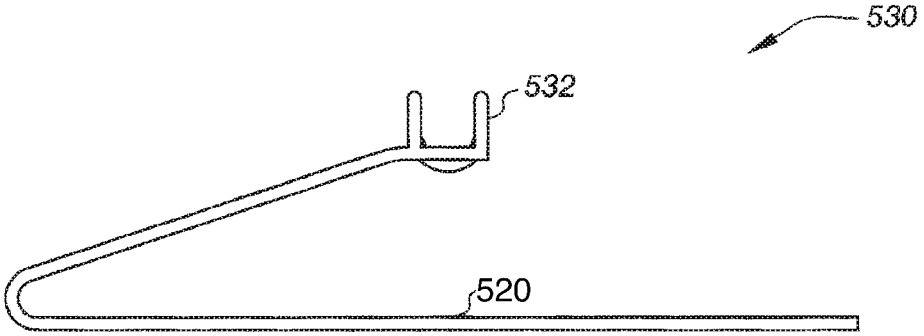
FIG. 5L is a front view of the fourth embodiment, auxiliary support.
Figure 5M:
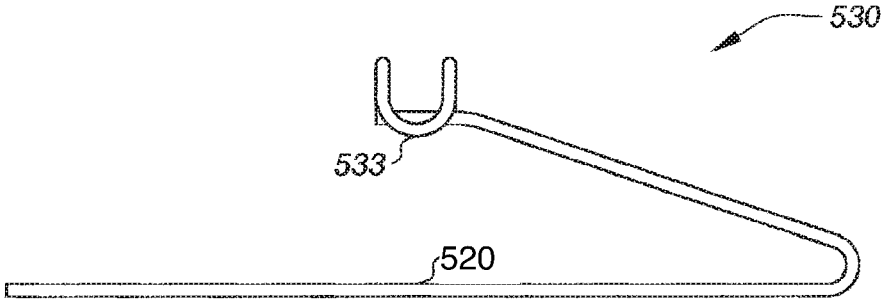
FIG. 5M is a back view of the fourth embodiment, auxiliary support.
Figure 5N:
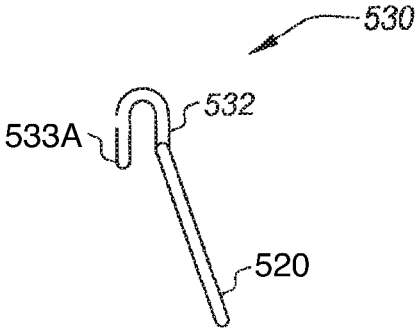
FIG. 5N is a right view of the fourth embodiment, auxiliary support.
Figure 5O:
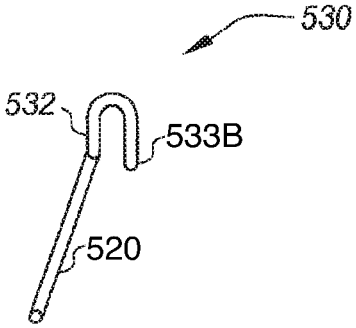
FIG. 5O is a left view of the fourth embodiment, auxiliary support.

FIGS. 5A-5O illustrate how embodiments of the invention can be realized using tubular or rod-shaped elements to form features of hanger 500.

Referring to FIG. 5A, a hanger 500 is shown having a primary support 510 for supporting a garment at its shoulders, shoulder straps, or other topmost portion; and an auxiliary support 530 for supporting a garment at its hems, cuffs, or other lowermost portion. Construction of this embodiment is similar to that of conventional hangers made of polyethylene tube or rod material with skirt clips, but including in the configuration the specific elements of the invention illustrated and described previously in connection with FIGS. 4A-4O.

This embodiment combines the auxiliary support structure having hooks 533 (533A and 533B) supported from a shank 532 as also illustrated by the embodiment shown in FIGS. 2A-2O with the primary support structure having a clip bar 520 and clips 54*o* as also illustrated by the embodiment shown in FIGS. 3A-3O. The attachment and detachment of the primary support 510 and the auxiliary support 530 is as described in connection with FIGS. 2A-2O, while the support of the garment is as described in connection with FIGS. 3A-3O.

Variations of this embodiment include, but are not limited to, versions produced without clips 540, e.g. for dresses and skirts, versions produced with clips on the bar of auxiliary support 530, and other variations and combinations disclosed and described herein in connection with different structural variations. Other variations of this embodiment also include the use of any other suitable polymer or other material to form the structure illustrated generally in FIGS. 5A-5O.

Figure 6D:
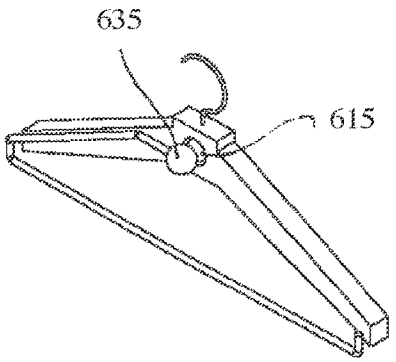
FIG. 6D is an axonometric view of the fifth embodiment of the hanger, assembled.
Figure 6E:
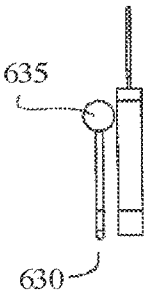
FIG. 6E is a right-side view of the fifth embodiment of the hanger, assembled.
Figure 6F:
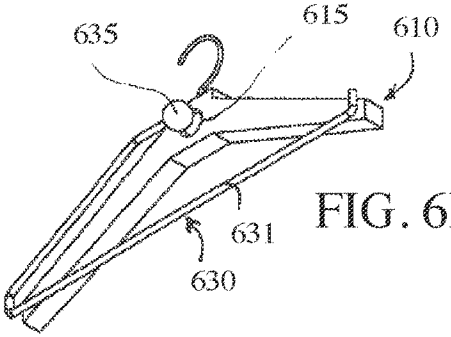
FIG. 6F is an axonometric view from a second angle of the fifth embodiment of the hanger, assembled.
Figure 6A:
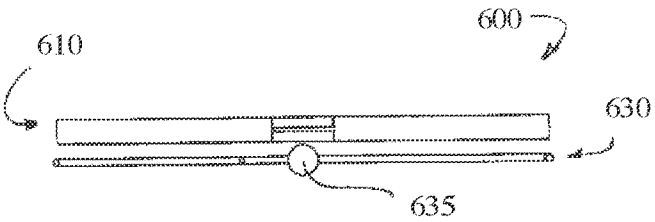
FIG. 6A is a top view of a fifth embodiment of the hanger, assembled.
Figure 6B:
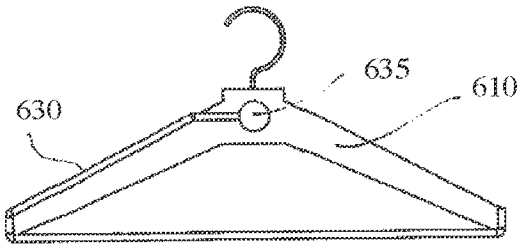
FIG. 6B is a front view of the fifth embodiment of the hanger, assembled.
Figure 6C:
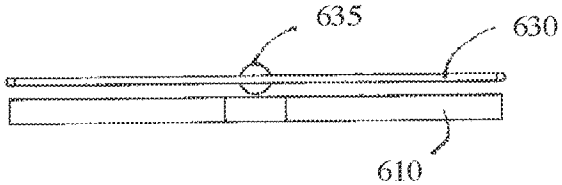
FIG. 6C is a bottom view of the fifth embodiment of the hanger, assembled.
Figure 6J:
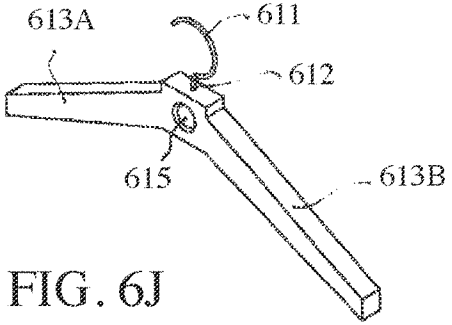
FIG. 6J is an axonometric view of the primary support of the fifth embodiment of the hanger.
Figure 6K:
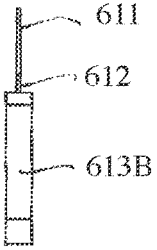
FIG. 6K is a right-side view of the primary support of the fifth embodiment of the hanger.
Figure 6L:
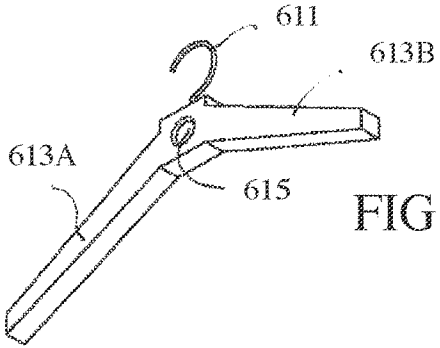
FIG. 6L is an axonometric view from a second angle of the primary support of the fifth embodiment of the hanger.
Figure 6G:
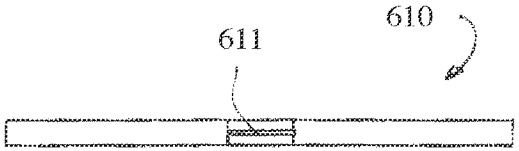
FIG. 6G is a top view of the primary support of the fifth embodiment of the hanger.
Figure 6H:
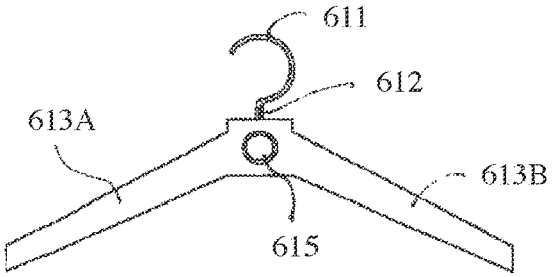
FIG. 6H is a front view of the primary support of the fifth embodiment of the hanger.
Figure 6I:
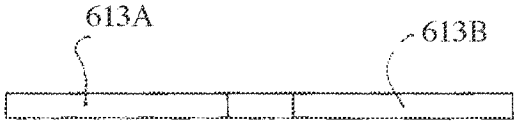
FIG. 6I is a bottom view of the primary support of the fifth embodiment of the hanger.
Figure 6P:
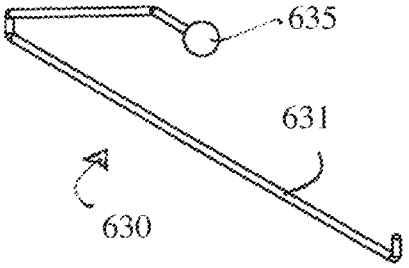
FIG. 6P is an axonometric view of the auxiliary support of the fifth embodiment of the hanger.
Figure 6Q:
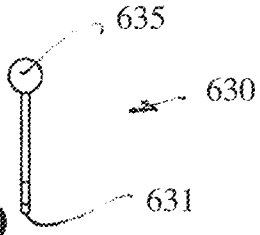
FIG. 6Q is a right-side view of the auxiliary support of the fifth embodiment of the hanger.
Figure 6R:
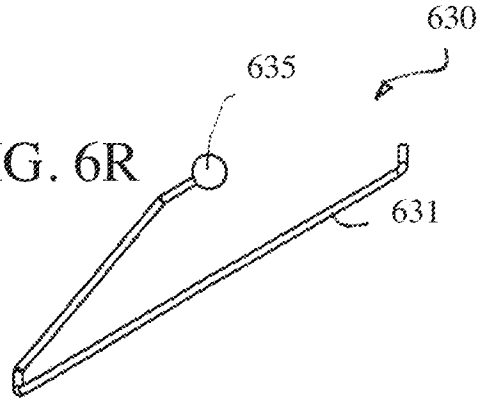
FIG. 6R is an axonometric view from a second angle of the auxiliary support of the fifth embodiment of the hanger.
Figure 6M:
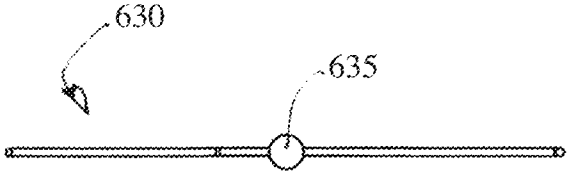
FIG. 6M is a top view of the auxiliary support of the fifth embodiment of the hanger.
Figure 6N:
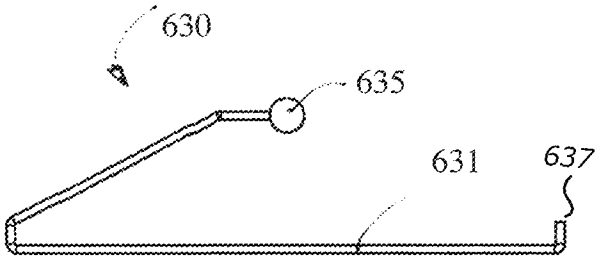
FIG. 6N is a front view of the auxiliary support of the fifth embodiment of the hanger.
Figure 6O:
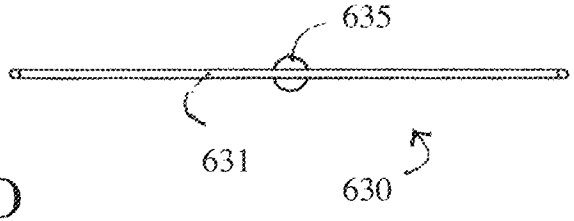
FIG. 6O is a bottom view of the auxiliary support of the fifth embodiment of the hanger.

FIGS. 6A-6R show an alternative embodiment comprising a hanger 600 having a different way of connecting a primary support 610 to an auxiliary support 630.

Referring to FIG. 6A, a hanger 600 is shown having a primary support 610 for supporting a garment at its shoulders, shoulder straps, or other topmost portion; and an auxiliary support 630 for supporting a garment at its hems, cuffs, or other lowermost portion. The auxiliary support 630 and the primary support 610 incorporate elements that detachably connect the auxiliary support 630 and the primary support 610. The connecting elements include a ball 635 and socket 615. The connecting elements of this embodiment are further described below.

FIGS. 6A-6F show the assembled hanger 600. The hanger 600 includes a primary support 610 and an auxiliary support 630. The primary support 610 and the auxiliary support 630 have functionality and design features largely as described above in connection with the previously-described embodiments. For example, the hanger 600 may include clips (not shown) as illustrated in other embodiments. Those features may be incorporated in various configurations and combinations as desired, and as described above. The hanger 600 of this embodiment differs from previous embodiments in that it includes ball 635 and socket 615 features for joining the primary support 610 and the auxiliary support 630 in a releasable structure.

FIGS. 6G-6L show further details of the primary support 610. The primary support 610 includes a hook 611 with a shank 612 for suspending the hanger 600, for example from a hanger bar in a closet. Arms 613A and 613B are constructed and arranged to support the top of a garment, for example by shoulders of the garment or straps.

The primary support 610 further includes a socket 615 for receiving the ball 635 of the auxiliary support 630. The ball and socket may be joined and held together by friction, by magnetic attraction, or by other suitable means that permits their later separation and reassembly. For example, the ball or socket surface may be coated with an elastomer or other high-friction material and sized for a bare interference fit between the ball and socket. Alternatively, the ball or socket may be a magnet, and the other may be steel or another magnet, so as to hold together by magnetic attraction.

FIGS. 6M-6R show further details of the auxiliary support 630. The auxiliary support 630 further includes the bar 631 for supporting the lower portion of a long garment, and the ball 635 for inserting in socket 615 of primary support 610. The bar 631 may have a diameter, covering, and/or surface quality suitable for retaining the type of garment for which the hanger is to be used. The bar 631 includes a lip 637.

Figure 7D:
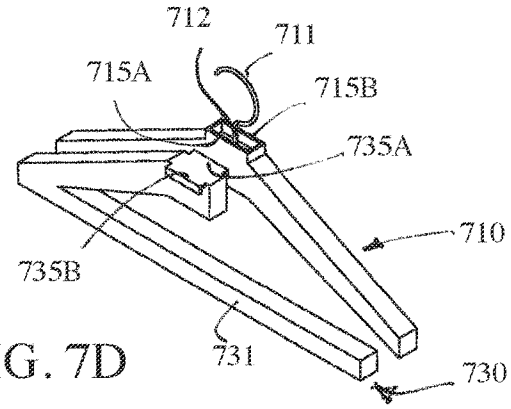
FIG. 7D is an axonometric view of the sixth embodiment of the hanger, assembled.
Figure 7E:
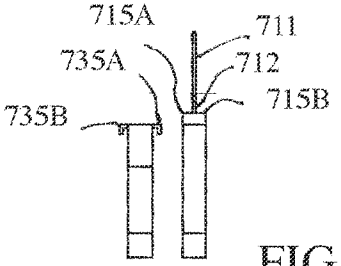
FIG. 7E is a right-side view of the sixth embodiment of the hanger, assembled.
Figure 7F:
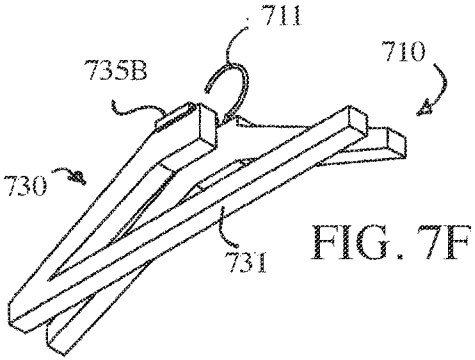
FIG. 7F is an axonometric view from a second angle of the sixth embodiment of the hanger, assembled.
Figure 7A:
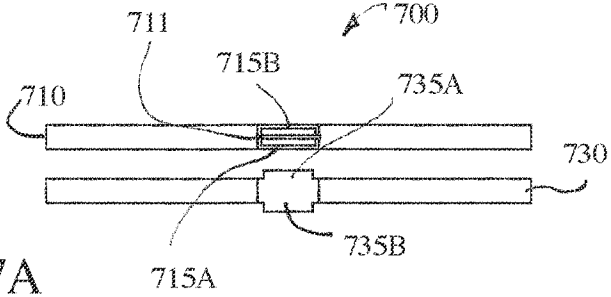
FIG. 7A is a top view of a sixth embodiment of the hanger, assembled.
Figure 7B:
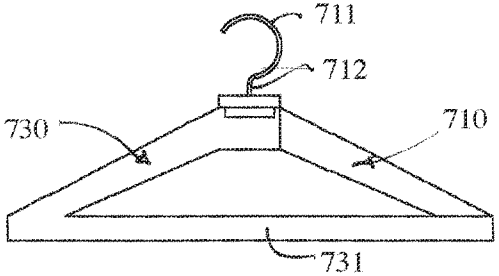
FIG. 7B is a front view of the sixth embodiment of the hanger, assembled.
Figure 7C:
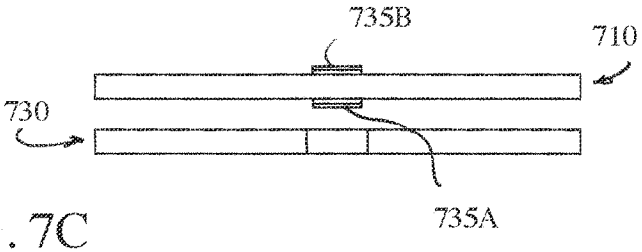
FIG. 7C is a bottom view of the sixth embodiment of the hanger, assembled.
Figure 7J:
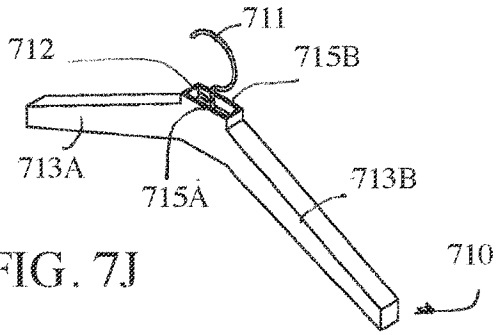
FIG. 7J is an axonometric view of the primary support of the sixth embodiment of the hanger.
Figure 7K:
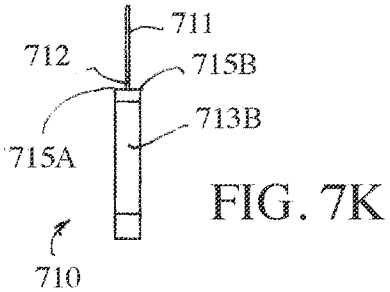
FIG. 7K is a right-side view of the primary support of the sixth embodiment of the hanger.
Figure 7L:
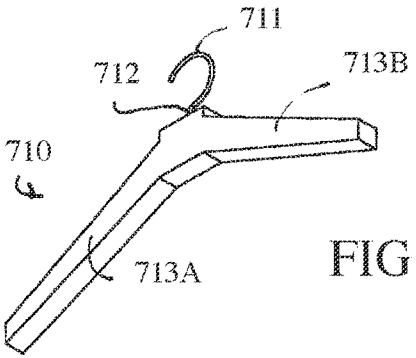
FIG. 7L is an axonometric view from a second angle of the primary support of the sixth embodiment of the hanger.
Figure 7G:
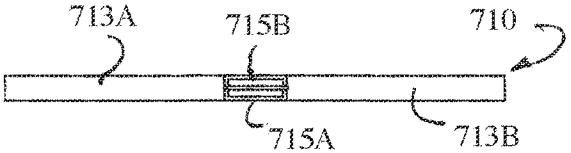
FIG. 7G is a top view of the primary support of the sixth embodiment of the hanger.
Figure 7H:
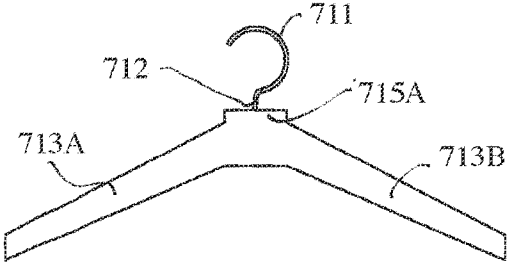
FIG. 7H is a front view of the primary support of the sixth embodiment of the hanger.
Figure 7I:
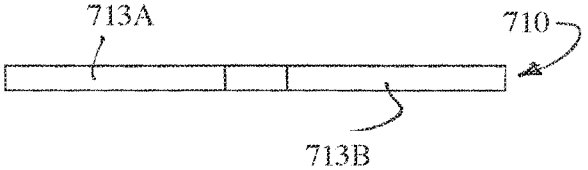
FIG. 7I is a bottom view of the primary support of the sixth embodiment of the hanger.
Figure 7P:
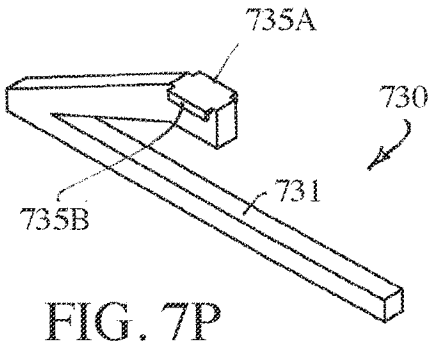
FIG. 7P is an axonometric view of the auxiliary support of the sixth embodiment of the hanger.
Figure 7Q:
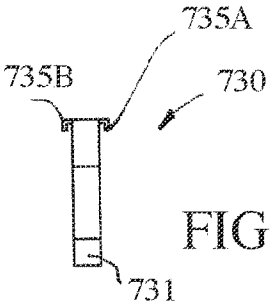
FIG. 7Q is a right-side view of the auxiliary support of the sixth embodiment of the hanger.
Figure 7R:
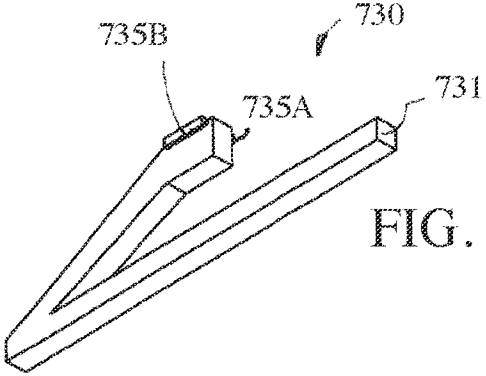
FIG. 7R is an axonometric view from a second angle of the auxiliary support of the sixth embodiment of the hanger.
Figure 7M:
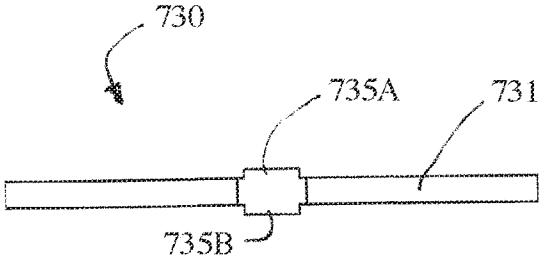
FIG. 7M is a top view of the auxiliary support of the sixth embodiment of the hanger.
Figure 7N:
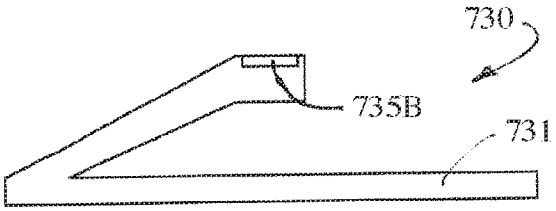
FIG. 7N is a front view of the auxiliary support of the sixth embodiment of the hanger.
Figure 7O:
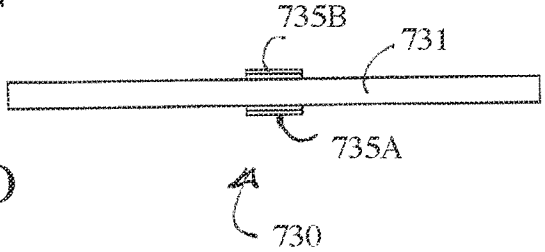
FIG. 7O is a bottom view of the auxiliary support of the sixth embodiment of the hanger.

FIGS. 7A-7R show an alternative embodiment comprising a hanger 700 having another way of connecting a primary support 710 to an auxiliary support 730.

Referring to FIG. 7A, a hanger 700 is shown having a primary support 710 for supporting a garment at its shoulders, shoulder straps, or other topmost portion; and an auxiliary support 730 for supporting a garment at its hems, cuffs, or other lowermost portion. The auxiliary support 730 and the primary support 710 incorporate elements that detachably connect the auxiliary support 730 and the primary support 710. The connecting elements include flange hooks 735A and 735B, and a raised ridge forming shoulders 715A and 715B. The connecting elements of this embodiment are further described below.

FIGS. 7A-7F show the assembled hanger 700. The hanger 700 includes a primary support 710 and an auxiliary support 730. The primary support 710 and the auxiliary support 730 have functionality and design features largely as described above in connection with the previously-described embodiments. For example, the hanger 700 may include clips (not shown) as illustrated in other embodiments. Those features may be incorporated in various configurations and combinations as desired, and as described above. The hanger 700 of this embodiment differs from previous embodiments in that it includes flange hooks 735A and 735B, and a raised ridge forming shoulders 715A and 715B for joining the primary support 710 and the auxiliary support 730 in a releasable structure.

FIGS. 7G-7L show further details of the primary support 710. The primary support 710 includes a hook 711 with a shank 712 for suspending the hanger 700, for example from a hanger bar in a closet. Arms 713A and 713B are constructed and arranged to support the top of a garment, for example by shoulders of the garment or straps.

The primary support 710 further includes a raised ridge forming shoulders 715A and 715B placed at or near a top edge of primary support 710, for receiving the hooks 735A and 735B of the auxiliary support 730. The hanger 700 is joined together by simply hanging a hook 735A or 735B from a corresponding shoulder 715A or 715B connecting auxiliary support 730 to either side of primary support 710 in a manner that permits their later separation and reassembly, as discussed elsewhere herein. A variation of this embodiment includes only one flange hook.

FIGS. 7M-7R show further details of the auxiliary support 730. The auxiliary support 730 further includes the bar 731 for supporting the lower portion of a long garment, and the hooks 735A and 735B for hanging from a corresponding shoulder 715A or 715B of primary support 710. The bar 731 may have a diameter, covering and/or surface quality suitable for retaining the type of garment for which the hanger is to be used.

Figure 8D:
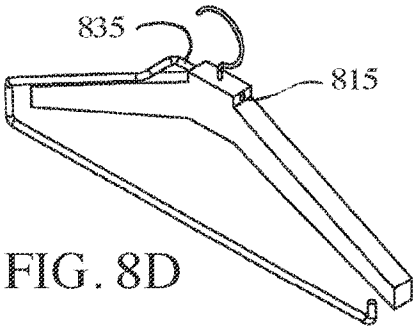
FIG. 8D is an axonometric view of the seventh embodiment of the hanger, assembled.
Figure 8E:
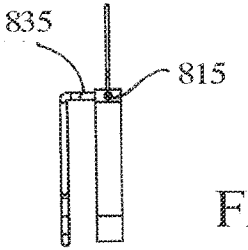
FIG. 8E is a right-side view of the seventh embodiment of the hanger, assembled.
Figure 8F:
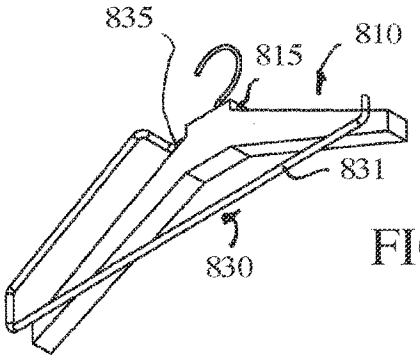
FIG. 8F is an axonometric view from a second angle of the seventh embodiment of the hanger, assembled.
Figure 8A:
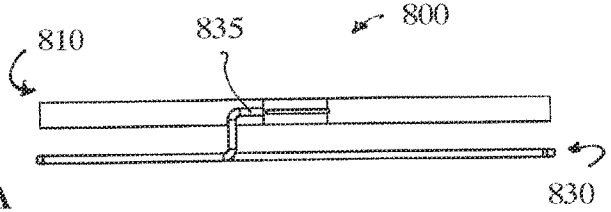
FIG. 8A is a top view of a seventh embodiment of the hanger, assembled.
Figure 8B:
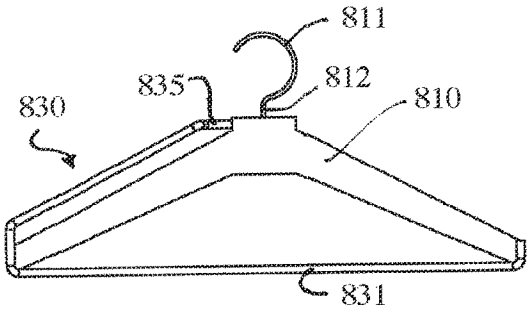
FIG. 8B is a front view of the seventh embodiment of the hanger, assembled.
Figure 8C:
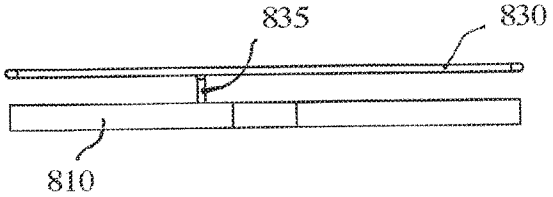
FIG. 8C is a bottom view of the seventh embodiment of the hanger, assembled.
Figure 8J:
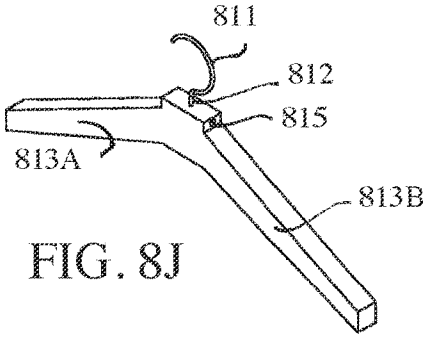
FIG. 8G is a top view of the primary support of the seventh embodiment of the hanger.
Figure 8K:
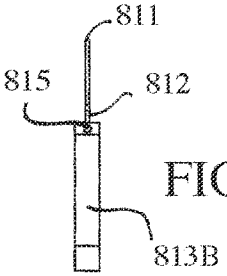
Figure 8L:
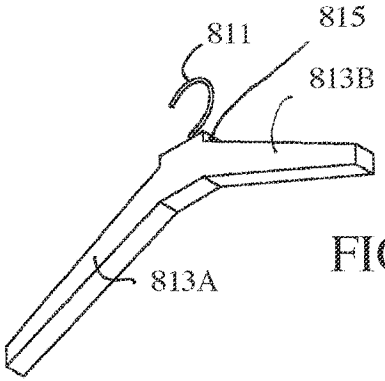
Figure 8G:
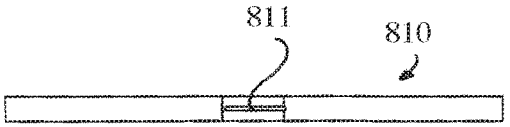
Figure 8H:
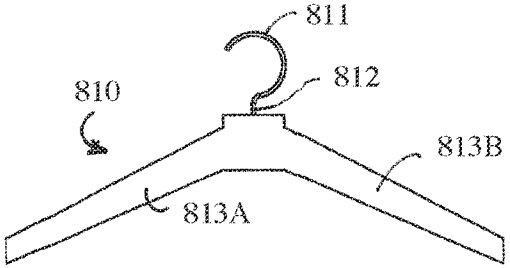
Figure 8I:
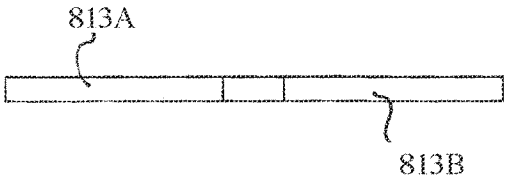
Figure 8P:
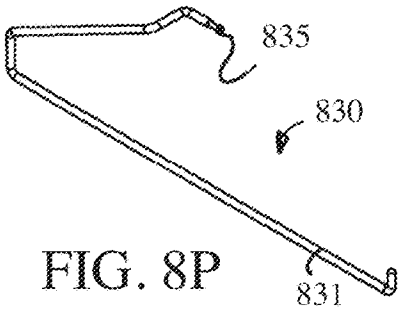
Figure 8Q:
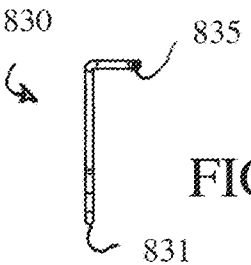
Figure 8R:
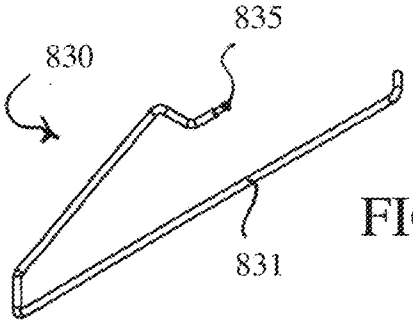
Figure 8M:
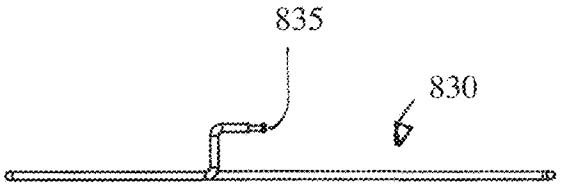
Figure 8N:
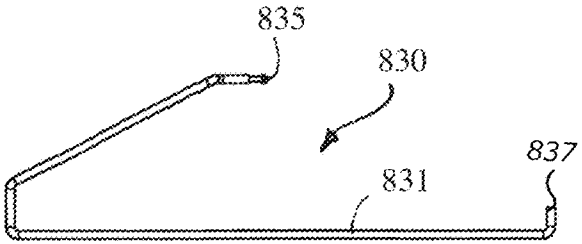
Figure 8O:
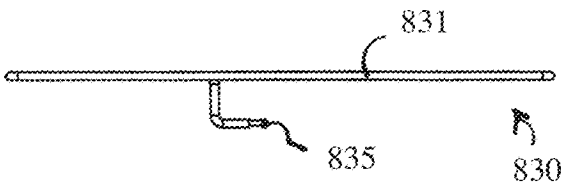

FIGS. 8A-8R show yet another alternative embodiment comprising a hanger 800 having another way of connecting a primary support Bio to an auxiliary support 830.

Referring to FIG. 8A, a hanger Boo is shown having a primary support 810 for supporting a garment at its shoulders, shoulder straps, or other topmost portion; and an auxiliary support 830 for supporting a garment at its hems, cuffs, or other lowermost portion. The auxiliary support 830 and the primary support 810 incorporate elements that detachably connect the auxiliary support 830 and the primary support 810. The connecting elements include a pin 835 and hole or socket 815. The connecting elements of this embodiment are further described below.

FIGS. 8A-8F show the assembled hanger 800. The hanger Boo includes a primary support 810 and an auxiliary support 830. The primary support 810 and the auxiliary support 830 have functionality and design features largely as described above in connection with the previously-described embodiments. For example, the hanger 800 may include clips (not shown) as illustrated in other embodiments. Those features may be incorporated in various configurations and combinations as desired, and as described above. The hanger 800 of this embodiment differs from previous embodiments in that it includes pin 835 and hole or socket 815 features for joining the primary support 810 and the auxiliary support 830 in a releasable structure. The structure may be sized to produce a friction fit between pin 835 and socket 815. Either pin 835 or socket 815 may further include a coating to increase friction between the two when joined.

FIGS. 8G-8L show further details of the primary support 810. The primary support 810 includes a hook 811 with a shank 812 for suspending the hanger 800, for example from a hanger bar in a closet. Arms 813A and 813B are constructed and arranged to support the top of a garment, for example by shoulders of the garment or straps.

The primary support 810 further includes socket 815 placed longitudinally through primary support 810 just below or adjacent to the attachment point of shank 812 for receiving the pin 835 of the auxiliary support 830. The hanger 800 is joined together by simply inserting pin 835 into socket 815 connecting auxiliary support 830 to primary support 810 in a manner that permits their later separation and reassembly, as discussed elsewhere herein.

FIGS. 8M-8R show further details of the auxiliary support 830. The auxiliary support 830 further includes the bar 831 for supporting the lower portion of a long garment, and the pin 835, which is a generally rod-shaped element having a sequence of bends whereby the pin has an end oriented longitudinally for insertion into socket 815 of primary support 810. The bar 831 may have a diameter, covering, and/or surface quality suitable for retaining the type of garment for which the hanger is to be used. The bar 831 includes a lip 837.

FIGS. 9A-9R show an alternative embodiment comprising a hanger 900 having a way of connecting a primary support 910 to an auxiliary support 930 with some features related to those of FIGS. 7A-7R.

Referring to FIG. 9A, a hanger 900 is shown having a primary support 910 for supporting a garment at its shoulders, shoulder straps, or other topmost portion; and an auxiliary support 930 for supporting a garment at its hems, cuffs, or other lowermost portion. The auxiliary support 930 and the primary support 910 incorporate elements that detachably connect the auxiliary support 930 and the primary support 910. The connecting elements include wire hooks 935A and 935B, and ridges 915A and 915B. The connecting elements of this embodiment are further described below.

FIGS. 9A-9F show the assembled hanger 900. The hanger 900 includes a primary support 910 and an auxiliary support 930. The primary support 910 and the auxiliary support 930 have functionality and design features largely as described above in connection with the previously-described embodiments. For example, the hanger 900 may include clips (not shown) as illustrated in other embodiments. Those features may be incorporated in various configurations and combinations as desired, and as described above. The hanger 900 of this embodiment differs from previous embodiments in that it includes hooks 935A and 935B, and ridges 915A and 915B features for joining the primary support 910 and the auxiliary support 930 in a releasable structure.

FIGS. 9G-9L show further details of the primary support 910. The primary support 910 includes a hook 911 with a shank 912 for suspending the hanger 900, for example from a hanger bar in a closet. Arms 913A and 913B are constructed and arranged to support the top of a garment, for example by shoulders of the garment or straps.

The primary support 910 further includes ridges 915A and 915B placed near the top of primary support 910, for receiving the hooks 935A and 935B of the auxiliary support 93*o*. Ridges 915A and 915B define a gap to allow hooks 935A and 935B to pass through the gap and securely catch on ridges 915A and 915B when auxiliary support 930 is attached to primary support 910. The hanger 900 is joined together by simply hanging hooks 935A and 935B from the ridges 915A and 915B (passing through one of the corresponding notches) connecting auxiliary support 930 to either side of primary support 910 in a manner that permits their later separation and reassembly, as discussed elsewhere herein.

FIGS. 9M-9R show further details of the auxiliary support 93*o*. The auxiliary support 930 further includes the bar 931 for supporting the lower portion of a long garment, and the hooks 935A and 935B. Hooks 935A and 935B are two halves of a double hook structure that may be fixedly attached to the top of auxiliary support 930 or may be attached by a U-bolt or staple 935C, so hooks 935A and 935B can be swung to either side of auxiliary support 93*o*, and thus hung from either side of primary support 910. The bar 931 may have a diameter, covering and/or surface quality suitable for retaining the type of garment for which the hanger is to be used.

FIGS. 10A-10R show an alternative embodiment comprising a hanger 1000 having a different way of connecting a primary support 1010 to an auxiliary support 1030, having some aspects similar to the ball and socket arrangement of FIGS. 6A-6R.

Referring to FIG. 10A, a hanger 1000 is shown having a primary support 1010 for supporting a garment at its shoulders, shoulder straps, or other topmost portion; and an auxiliary support 1030 for supporting a garment at its hems, cuffs, or other lowermost portion. The auxiliary support 1030 and the primary support 1010 incorporate elements that detachably connect the auxiliary support 1030 and the primary support 1010. The connecting elements include a tab 1035 and sockets 1015A and 1015B. The connecting elements of this embodiment are further described below.

FIGS. 10A-10F show the hanger 1000. The hanger 1000 includes a primary support 1010 and an auxiliary support 1030. The primary support 1010 and the auxiliary support 1030 have functionality and design features largely as described above in connection with the previously-described embodiments. For example, the hanger 1000 may include clips (not shown) as illustrated in other embodiments. Those features may be incorporated in various configurations and combinations as desired, and as described above. The hanger 1000 of this embodiment differs from previous embodiments in that it includes tab 1035 and sockets 1015A and 1015B features for joining the primary support Imo and the auxiliary support 1030 in a releasable structure. Attachment in this embodiment is achieved by insertion of the tab 1035 into one of the sockets 1015A and 1015B from below, but tab 1035 and sockets 1015A and 1015B could be arranged horizontally as well.

FIGS. 10G-10L show further details of the primary support 1010. The primary support 1010 includes a hook 1011 with a shank 1012 for suspending the hanger 1000, for example from a hanger bar in a closet. Arms 1013A and 1013B are constructed and arranged to support the top of a garment, for example by shoulders of the garment or straps.

The primary support 1010 further includes sockets 1015A and 1015B for receiving the tab 1035 of the auxiliary support 1030. The tab and socket may be joined and held together by friction, by magnetic attraction, or by other suitable means that permits their later separation and reassembly, as discussed elsewhere herein. Tab 1035 and sockets 1015A and 1015B could further include friction-increasing coatings or magnetic features as described in connection with FIGS. 6A-6R, above.

FIGS. 10M-10R show further details of the auxiliary support 1030. The auxiliary support 1030 further includes the bar 1031 for supporting the lower portion of a long garment, and the tab 1035 for inserting in either of sockets 1015A and 1015B of primary support 1010. The bar 1031 may have a diameter, covering and/or surface quality suitable for retaining the type of garment for which the hanger is to be used.

FIGS. 11A-11R show yet another alternative embodiment comprising a hanger 1100 having another way of connecting a primary support 1110 to an auxiliary support 1130, similar in some respects to the hanger 800 of FIGS. 8A-8R.

Referring to FIG. 11A, a hanger 1100 is shown having a primary support 1110 for supporting a garment at its shoulders, shoulder straps, or other topmost portion; and an auxiliary support 1130 for supporting a garment at its hems, cuffs, or other lowermost portion. The auxiliary support 1130 and the primary support 1110 incorporate elements that detachably connect the auxiliary support 1130 and the primary support 1110. The connecting elements include a pin 1135 and hole or socket 1115. The connecting elements of this embodiment are further described below.

FIGS. 11A-11F show the assembled hanger 1100. The hanger 1100 includes a primary support 1110 and an auxiliary support 1130. The primary support 1110 and the auxiliary support 1130 have functionality and design features largely as described above in connection with the previously-described embodiments. For example, the hanger 1100 may include clips (not shown) as illustrated in other embodiments. Those features may be incorporated in various configurations and combinations as desired, and as described above. The hanger 1100 of this embodiment differs from previous embodiments in that it includes pin 1135 and hole or socket 1115 features for joining the primary support 1110 and the auxiliary support 1130 in a releasable structure. The structure may be sized to produce a friction fit between pin 1135 and socket 1115. Either pin 1135 or socket 1115 may further include a coating to increase friction between the two when joined.

FIGS. 11G-11L show further details of the primary support 1110. The primary support 1110 includes a hook 1111 with a shank 1112 for suspending the hanger 1100, for example from a hanger bar in a closet. Arms 1113A and 1113B are constructed and arranged to support the top of a garment, for example by shoulders of the garment or straps.

The primary support 1110 further includes socket 1115 placed transversely through primary support 1110 just below or adjacent to the attachment point of shank 1112 for receiving the pin 1135 of the auxiliary support 1130. The hanger 1100 is joined together by simply inserting pin 1135 into socket 1115 connecting auxiliary support 1130 to primary support 1110 in a manner that permits their later separation and reassembly, as discussed elsewhere herein.

FIGS. 11M-8R show further details of the auxiliary support 1130. The auxiliary support 1130 further includes the bar 1131 for supporting the lower portion of a long garment. The pin 1135 is a generally rod-shaped element having a sequence of bends whereby the pin has an end oriented transversely for insertion into socket 1115 of primary support 1110. The bar 1131 may have a diameter, covering and/or surface quality suitable for retaining the type of garment for which the hanger is to be used.

FIGS. 12-14 show by steps, how to use the invention, using the hanger 300 of FIGS. 3A-3O.

In FIG. 12, the hanger 300 has been separated into the primary support 310 and the auxiliary support 330 (not shown). The primary support 310 is employed in a fashion similar to a conventional hanger. Once the parts are separated, the primary support 310 resembles a conventional hanger. A garment is hung on arms 313A and 313B of the primary support 310, in a conventional manner. The arms 313A and 313B of the primary support 310 in the exemplary embodiment shown includes clips for retaining garments that do not drape over arms 313A and 313B more securely.

In FIG. 13, the lower end of the garment is draped over a bar 331 of the auxiliary support 330. The bar 331 of the exemplary embodiment does not include hooks, detents, one or more clips, or other means to retain the lower end of the garment, but could include such features. As next shown, FIG. 14 illustrates the hanger 300 reassembled so that primary support 310 and auxiliary support 330 cooperate to support the garment in a new way.

What is claimed is:

1. A hanger, comprising:

a primary support including a hook and a set of arms operable to suspend a top portion of a garment; and a secondary support having a body portion, wherein a first end of the body portion includes a loop dependent from a top portion of the secondary support, the loop including a gap through which the hook of the primary support passes, wherein the hook passes through the gap, and wherein the loop engages around a top portion of the primary support proximate to the hook to support the secondary support from the primary support, and wherein a second end of the body portion includes a bar extending substantially horizontally for suspending a connected bottom portion of the garment and shortening a total length of the garment being supported by the primary support, the bar defining an opening formed between the bar and the body portion of the secondary support, the opening operable to pass a portion of the garment therethrough, and wherein the bar includes a distal end portion, the distal end portion including a transversely projecting lip integrally formed at the distal end portion of the bar and extending upwardly to define a garment-engaging surface operable to frictionally engage and retain the bottom portion of the garment on the bar.

2. The hanger of claim 1, wherein the lip comprises a protruding edge integrally formed at and extending upwardly from a distal end of the bar, the protruding edge forming the garment-engaging surface.

3. The hanger of claim 1, wherein the lip comprises a curved bend integrally formed at a distal end of the bar, the curved bend forming the garment-engaging surface extending upwardly relative to the bar.

4. The hanger of claim 1, wherein the bar includes one of a covering or surface quality suitable for producing a friction assist to support a position of the bottom portion of the garment on the bar.

5. The hanger of claim 1, wherein the bar has an outer diameter dimensioned to frictionally engage the bottom portion of the garment to resist garment movement along the bar.

6. The hanger of claim 1, wherein the loop is hingedly coupled to the top portion of the secondary support.

7. The hanger of claim 6, wherein the loop swings on a hinge to a front position or a back position, so as to support the secondary support in front and back positions relative to the primary support.

8. The hanger of claim 1, wherein the loop swings on the hook to a front position or a back position, so as to support the secondary support in front and back positions relative to the primary support.

9. The hanger of claim 1, wherein the primary support includes a set of ridges extending upwardly partially around a top edge of the primary support adjacent the hook, and wherein the connecting element includes a hook dependent from a top edge of the secondary support, wherein the hook hooks onto the set of ridges to support the secondary support from the primary support.

10. The hanger of claim 1 wherein the connecting element includes:

a double hook dependent from a top portion of the secondary support, the double hook including a gap through which the hook of the primary support passes, wherein the hook passes through the gap and the double hook hooks onto the primary support.

11. The hanger of claim 1, further including:

one of a front flange hook or a back flange hook extending transversely near a top edge of the secondary support; and a raised ridge extending upwardly near a top edge of the primary support adjacent the hook, wherein the one of the front flange hook or the back flange hook engages the raised ridge to support the secondary support from the primary support.

12. The hanger of claim 1, wherein the primary support and the secondary support are constructed from one of either a reinforced plastic, an unreinforced plastic, a suitable 3-D printing matrix material, acrylic, wood, or lucite.

13. The hanger of claim 1, wherein the connecting element includes a hook and loop fastener elements, the hook and loop fastener elements including patches of hook-and-loop fastener on the secondary support and the primary support.

14. The hanger of claim 1, wherein the primary support includes arms extending from the primary support to provide support to shoulders or shoulder straps of the garment.

15. The hanger of claim 1, wherein the primary support includes a clip bar, the clip bar comprising at least one clip.

16. The hanger of claim 15, wherein the at least one clip on the clip bar is adjustable along a length of the bar.

17. The hanger of claim 1, wherein the primary support and the secondary support are interconnected, with their relative positions being adjustable to alter the total length of the garment being supported.

* * * * *